US009126427B2

(12) United States Patent
Moriyama

(10) Patent No.: US 9,126,427 B2
(45) Date of Patent: Sep. 8, 2015

(54) PRINTER AND CONTROL METHOD THEREFOR

(71) Applicant: Seiko Epson Corporation, Tokyo (JP)

(72) Inventor: Ryuji Moriyama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/323,611

(22) Filed: Jul. 3, 2014

(65) Prior Publication Data

US 2015/0009258 A1 Jan. 8, 2015

(30) Foreign Application Priority Data

Jul. 4, 2013 (JP) ..... 2013-140425
Jul. 4, 2013 (JP) ..... 2013-140428

(51) Int. Cl.
*B41J 29/38* (2006.01)
*B41J 13/00* (2006.01)
*B41J 3/60* (2006.01)

(52) U.S. Cl.
CPC ..... *B41J 13/0009* (2013.01); *B41J 3/60* (2013.01)

(58) Field of Classification Search
CPC ..... B41J 11/0095; B41J 3/60; B41J 11/42; B41J 13/0009; B41J 11/007; B41J 13/009; B41J 29/38; H04N 1/00602; H04N 1/00578; H04N 1/0057; H04N 1/12; B65H 5/26; B65H 2301/33312; B65H 2220/02; B65H 7/02
USPC ..... 347/8, 16, 101, 104; 271/226, 227, 278, 271/287, 3.14, 4.1
See application file for complete search history.

(56) References Cited

U.S. PATENT DOCUMENTS

| | | | | |
|---|---|---|---|---|
| 8,277,016 | B2 * | 10/2012 | Moriyama et al. | 347/16 |
| 8,668,300 | B2 * | 3/2014 | Samoto et al. | 347/16 |
| 2007/0030299 | A1 | 2/2007 | Izuchi | |
| 2010/0302298 | A1 | 12/2010 | Moriyama et al. | |
| 2013/0208326 | A1 * | 8/2013 | Nose et al. | 358/498 |

FOREIGN PATENT DOCUMENTS

| | | | |
|---|---|---|---|
| JP | 2007-038562 | A | 2/2007 |
| JP | 2010-275085 | A | 12/2010 |
| JP | 2011-051747 | A | 3/2011 |

* cited by examiner

*Primary Examiner* — An Do
(74) *Attorney, Agent, or Firm* — Nutter McClennen & Fish LLP; John J. Penny, Jr.

(57) ABSTRACT

The control unit of a printer feeds paper P from a paper supply path 12 to a main conveyance path, drives a paper feed roller pair, conveys the paper in a first direction through the main conveyance path, and prints on the first side of the paper. After printing on the first side ends, the conveyance direction changes from the first direction to the opposite second direction, and the medium is back-fed to a looped inverting conveyance path at a faster conveyance speed than the conveyance speed when printing. First and second conveyance rollers are then driven to convey the print medium at high speed through the inverting conveyance path, thereby inverting the front and back and returning the medium to the main conveyance path for printing the second side.

18 Claims, 12 Drawing Sheets

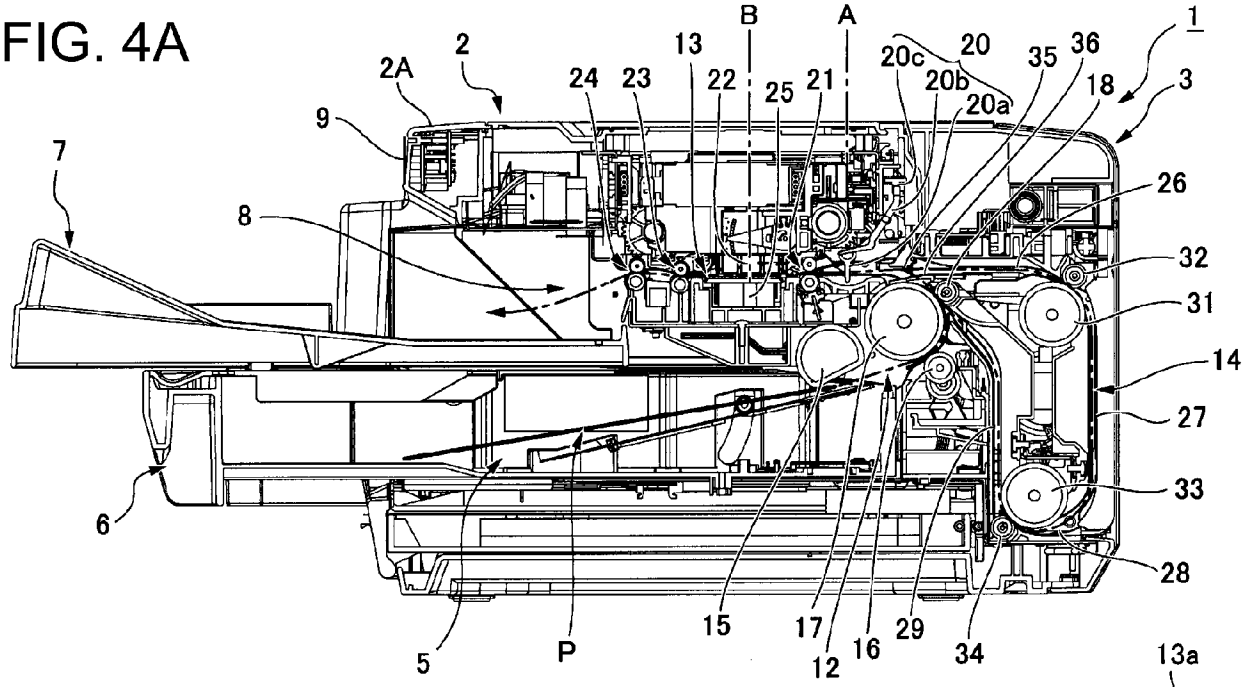
FIG. 4A
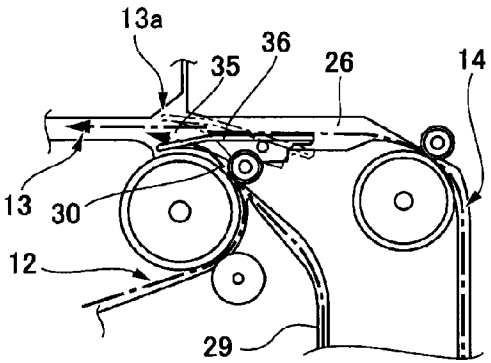
FIG. 4B
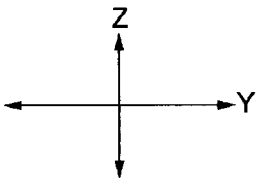

PRINTER AND CONTROL METHOD THEREFOR

Priority is claimed under 35 U.S.C. §119 to Japanese Patent Application No. 2013-140425 filed on Jul. 4, 2013, and Japanese Patent Application No. 2013-140428 filed on Jul. 4, 2013, which are hereby incorporated by reference in their entirety.

BACKGROUND

1. Technical Field

The present invention relates to a printer having an inverting conveyance path that inverts the front and back sides of recording paper or other sheet media while the media is conveyed, and to a control method of the printer.

The present application claims priority based on and incorporates by reference the entire contents of Japan Patent Application No. 2013-140425 filed in Japan on Jul. 4, 2013, and Japan Patent Application No. 2013-140428 filed on Jul. 4, 2013.

2. Related Art

Printers with an automatic duplex (two-sided) print function are one example of a printer with a inverting conveyance path. In a printer with an automatic duplex print function, the recording paper is printed on one (front) side, the front and back of the recording paper are then reversed by conveyance through the inverting conveyance path, and the other (back, second) side of the recording paper is then printed. JP-A-2007-38562 discloses a printer with an inverting conveyance path.

Problems can occur when the recording paper is conveyed to the inverting conveyance path and reversed after printing the front. These problems include a drop in print quality as a result of ink that has not dried yet sticking to the conveyance mechanism, and paper jams resulting from changes in the paper caused by the ink. The printer disclosed in JP-A-2007-38562 applies control to prevent the occurrence of such problems. More specifically, after printing on the front, the recording paper is reversed at slow speed until the trailing end of the recording paper is just before the paper feed roller pair, the recording paper then pauses at this position until the ink is completely dry, and back-feeding then resumes to feed the recording paper into the inverting conveyance path and reverse the recording paper.

The printer taught in JP-A-2007-38562 dries the ink after the trailing end of the recording paper is returned to immediately before the paper feed roller pair. The success rate of the recording paper nipping operation of the paper feed roller pair is therefore high, and the chance of paper jams occurring during the inverting operation is low. Furthermore, because the inverting operation occurs after waiting for the ink to dry completely, ink bleeds and ink sticking to the paper feed rollers is prevented. A drop in print quality can also be prevented.

The media inverting conveyance control method of the printer disclosed in JP-A-2007-38562 requires a long time for the inverting operation, however, because media is conveyed at low speed in reverse and there is a wait period imposed for the ink to dry in front of the paper feed roller pair. Throughput therefore drops during duplex printing. Setting the desirable length of the wait period for drying the ink is also difficult because the appropriate wait time varies according to the type of recording paper. The wait period must also be set to the longest possible drying time when printing on multiple different types of paper is possible in order to reliably dry the ink on all types of paper. The time required for the inverting operation may therefore become unnecessarily long. Paper jams can also occur in inkjet printers because of ink-induced changes in the paper before the recording paper is fed into the inverting conveyance path, but the literature is silent about a means of avoiding such problems, and a means of suppressing a drop in throughput.

In addition, when the recording paper is reversed after printing and fed into the inverting conveyance path, the condition of the trailing end of the recording paper before reverse conveyance starts differs according to the content printed on the front printing surface and the printing method. For example, when the recording paper is printed nearly to the trailing end, the trailing end of the recording paper may have left the nipping point of the paper feed roller pair before reverse conveyance starts. Because the paper feed roller pair may fail to nip the recording paper during reverse conveyance when this happens, paper jams can occur if nipping failures cannot be avoided, and throughput will drop. The position of the trailing end of the media when printing is completed differs according to how the last printing pass was printed when printing on the front side, and this affects throughput.

Printing on the front side may also end while the trailing end of the recording paper is in the paper conveyance path on the upstream side of the junction to the inverting conveyance path. If inverting the recording paper is started from this position after printing the front ends, the recording paper will be fed to the paper cassette side, and cannot be fed into the inverting conveyance path. Therefore, the recording paper must be conveyed in the same direction as the printing direction until the trailing end of the recording paper is on the downstream side of the junction before reverse conveyance can start. However, this forward conveyance is meaningless and lowers throughput unnecessarily when the trailing end of the recording paper has already escaped from the nipping point of the paper feed path.

When feeding the recording paper in reverse to the inverting conveyance path after printing on the front printing surface of the medium in a printer that can print automatically on both sides of media, optimal conveyance control differs according to the state of the trailing end of the recording paper when reverse conveyance starts, and throughput may drop unnecessarily if conveyance control is the same at all times. The control method taught in JP-A-2007-38562 does not address this problem.

SUMMARY

With consideration for the foregoing problem, a printer according to the invention capable of automatic duplex printing by printing one (front) side of the recording paper, reversing and feeding the recording paper into a inverting conveyance path to reverse the front and back sides, and then printing the other (back) side, suppresses a drop in print quality and paper jams during duplex printing and improves throughput.

The present invention is directed to solving at least part of the foregoing problem as described in the following embodiments and examples thereof.

Example 1

A first aspect of the invention is a control method of a printer, the control method including: a first step of conveying a sheet medium delivered to a media conveyance path in a first direction, and printing on a first side of the medium by a printhead; a second step of conveying the printed medium in a second direction in the reverse of the first direction from the media conveyance path to a loop-shaped inverting conveyance path; and a third step of conveying the medium through the inverting conveyance path and feeding the medium in the first direction from the inverting conveyance path to the media conveyance path after inverting the front and back; wherein the medium is conveyed in the second direction in the second step at a higher conveyance speed than the conveyance speed when conveying the medium in the first direction in the first step.

After printing on the first side of the medium, the control method according to this aspect of the invention changes the conveyance direction to the opposite direction (second direction) as when printing, conveys the medium faster than when printing, and inverts the front and back of the medium. This shortens the time required to complete the media inversion operation compared with slowing the conveyance speed of the medium during inversion, or imposing a waiting period for the ink to dry. In addition, when the trailing end of the medium is no longer between the conveyance roller pair when printing ends, the trailing end of the medium can be returned to between the conveyance roller pair while there is still little change in the condition of the medium, and can improve the success rate of the operation nipping the trailing end of the medium with the conveyance roller pair. The chance of a paper jam occurring is therefore low. In tests of conveyance control in an inkjet printer, the inventors confirmed there is little ink bleeding in the medium after printing, and little transfer of ink to the conveyance roller pair. Loss of print quality and the occurrence of paper jams can therefore be suppressed, and throughput can be improved in duplex printing. Paper jams can also be reduced and throughput improved when printing with a printhead other than an inkjet head.

Example 2

In a control method of a printer according to another aspect of the invention, the first steps conveys the medium in the first direction through the media conveyance path by driving a first conveyance motor; and the third step conveys the medium through the inverting conveyance path at a higher speed than the conveyance speed when conveying the medium in the first direction in the first step by driving a second conveyance motor different from the first conveyance motor.

By using a dedicated motor disposed to the inverting unit to convey media through the inverting conveyance path, this method enables conveying and inverting the medium at a faster speed than when printing.

Example 3

In a control method of a printer according to another aspect of the invention, the second step includes detecting the medium conveyed in the second direction by a media detector disposed on the second direction side of the print position of the printhead, determining if nipping the medium between a paper feed roller pair disposed between the print position and the detection position of the media detector was successful based on the output of the media detector, executing a retry operation that conveys the medium in the first direction and then in the second direction when the nipping operation is determined to have failed, and repeating the retry operation until the nipping operation succeeds.

This method can prevent media from stopping and jamming in front of the conveyance roller pair because conveyance can be stopped when nipping fails. The medium can also be fed quickly to the inverting conveyance path because the nipping operation can be repeated until the nipping operation succeeds.

Example 4

In a control method of a printer according to another aspect of the invention, the retry operation pauses the medium for a predetermined wait period before starting conveyance in the second direction after conveying the medium in the first direction.

This method can prevent ink bleeding and ink transferring to the conveyance roller pair, and improve the success rate of the retry operation.

Example 5

In a control method of a printer according to another aspect of the invention, the medium is conveyed in the second direction in the retry operation at a slower speed than the conveyance speed when conveying the medium in the first direction in the first step.

This method can prevent ink bleeding and ink transferring to the conveyance roller pair, and improve the success rate of the retry operation.

Example 6

In a control method of a printer according to another aspect of the invention, nipping between the paper feed roller pair is released when conveying the medium in the second direction in the retry operation.

This method can improve the success rate of the retry operation by separating one roller from the other roller of the conveyance roller pair.

Example 7

In a control method of a printer according to another aspect of the invention, the printhead is an inkjet head that ejects ink to the medium; and the control method further comprising a step of positioning the inkjet head and the carriage that carries the inkjet head to a standby position where part of the carriage overlaps part of the medium passing through the media conveyance path and the nozzle face of the inkjet head is retracted from the position overlapping the medium before starting the second step after printing on the first side of the medium.

This method can suppress the occurrence of paper jams because deformation of the media by ink can be limited by the carriage. Printing on the second side of the medium can also start from the standby position, and printing on the back side can therefore start quickly.

Example 8

A control method of a printer according to another aspect of the invention has a first step of conveying a sheet medium fed from a media delivery path to a media conveyance path in a first direction, and printing on a first side of the medium by a printhead; a second step of conveying the printed medium in a second direction in the reverse of the first direction from the media conveyance path to a loop-shaped inverting conveyance path; and a third step of conveying the medium through the inverting conveyance path and feeding the medium in the first direction from the inverting conveyance path to the media conveyance path after inverting the front and back; wherein the conveyance position of the trailing end of the medium when printing on the first side of the medium in the first step ends is determined; and at least one of controlling printing on the first side of the medium, and controlling conveyance of the medium after the first side is printed, is based on the result of determining the conveyance position.

To change the conveyance direction to the direction opposite the printing direction and feed the medium to the inverting conveyance path after printing on one side of the medium during duplex printing, this method of the invention first determines the conveyance position of the trailing end of the medium when printing on the one side is completed, that is, the conveyance position of the trailing end of the medium before starting the operation that feeds the medium into the inverting conveyance path. When feeding the medium to the inverting conveyance path in the opposite direction as when printing, optimum conveyance control resulting in the shortest conveyance distance and few problems such as paper jams and failing to feed the medium into the inverting conveyance path differs according to the starting position of the conveyed medium. The conveyance position of the medium when printing ends can be adjusted by means of control when printing as well as by conveyance control after printing. This control method can therefore suppress problems such as paper jams and improve throughput during duplex printing.

Example 9

In a control method of a printer according to another aspect of the invention, a conveyance roller pair that conveys the medium to the second direction side of the printhead is disposed to the media conveyance path, and a junction is disposed on the second direction side of the conveyance roller pair between the media delivery path and the inverting conveyance path and media conveyance path; the junction is configured to feed the medium from the media delivery path to the media conveyance path in the first direction, and feed the medium from the media conveyance path to the inverting conveyance path in the second direction. The control method includes determining if the conveyance position of the trailing end of the medium when printing on the first side of the medium in the first step ends is in an un-nipped area between the conveyance roller pair and the printhead, a reversible area between the conveyance roller pair and the junction, or a non-reversible area on the media delivery path side of the junction; and at least one of controlling printing on the first side of the medium, and controlling conveyance of the medium after the first side is printed, is based on the result of determining the conveyance position.

This method determines whether or not to apply control based on the success of the operation nipping the trailing end of the medium with the conveyance roller pair based on whether or not the trailing end of the medium has separated from between the conveyance roller pair. Whether the medium must be conveyed further in the first direction after printing one side ends also depends on if the trailing end of the medium is on the media delivery path side. This aspect of the invention can therefore suppress an unnecessary drop in throughput, and suppress problems such as paper jams.

Example 10

A control method of a printer according to another aspect of the invention also includes conveying the medium further in the first direction after printing on the first side of the medium ends in the first step, moving the trailing end of the medium into the reversible area, and then starting conveyance in the second direction in the second step, when the conveyance position of the trailing end of the medium when printing on the first side of the medium ends is determined to be in the non-reversible area.

This method enables reliably feeding the medium into the inverting conveyance path.

Example 11

In a control method of a printer according to another aspect of the invention, a recording means formation area is disposed to the printhead at a position facing the medium through a specific range of the medium conveyance direction; the first step conveys the medium in the first direction and prints on the medium each time the printhead scans a direction perpendicular to the first direction; and when the conveyance position of the trailing end of the medium is determined to be in the un-nipped area when printing on the first side of the medium ends, the conveyance position of the medium during the last scan by the printhead in the first step, and printing on the first side of the medium, are controlled so that the print data printed to a position closest to the trailing end of the first side of the medium is printed using the recording means disposed in the recording means formation area nearest the conveyance roller pair.

This method enables minimizing the distance between the trailing end of the medium when printing on the first side ends and the conveyance roller pair. The medium can therefore be conveyed to between the conveyance roller pair while there is little change in the medium, and can improve the success rate of the nipping operation. Throughput can also be improved because the conveyance distance for feeding the medium to the inverting conveyance path is short and the time required for the inversion operation is short.

Example 12

A control method of a printer according to another aspect of the invention also has a fourth step of conveying the medium fed to the media conveyance path in the first direction after inverting the front and back sides in the third step, and printing on the second side of the medium by the printhead, the fourth step conveying the medium in units of the maximum width that can be printed in one pass of the printhead and printing on the second side each time the printhead scans in a direction perpendicular to the first direction.

This method enables controlling the conveyance position of the medium when printing on the second side ends after inversion to as far downstream as possible, and enables printing the last pass when the length of un-nipped medium at the trailing end is as short as possible. A drop in print quality due to deformation of the medium can therefore be suppressed. Throughput can also be improved because the medium can be quickly discharged and printing the next medium can start quickly.

Example 13

In a control method of a printer according to another aspect of the invention, when the conveyance position of the trailing end of the medium is determined to be in the un-nipped area when printing on the first side of the medium ends, the second step includes detecting the medium conveyed in the second direction by a media detector disposed on the second direction side of the conveyance roller pair, determining based on the output from the media detector if a nipping operation that nips the medium between the conveyance roller pair is successful, executing a retry operation that conveys the medium in the first direction and then conveys the medium in the second direction when the nipping operation is determined to have failed, and repeating the retry operation until the nipping operation succeeds.

This method can prevent media from jamming in front of the conveyance roller pair, creating a paper jam. The time required to feed the medium into the inverting conveyance path can also be shortened and throughput improved because the retry operation repeats automatically until the nipping operation succeeds.

Example 14

Another aspect of the invention is a printer comprising: a media conveyance path that conveys a sheet medium; a printhead that prints on media conveyed through the media conveyance path; a loop-shaped inverting conveyance path that inverts the front and back of media fed thereto from the media conveyance path and returns the media to the media conveyance path; a media conveyance means that conveys the medium through the media conveyance path; an inverting conveyance means that conveys the medium through the inverting conveyance path; and a control unit that controls the printhead, the media conveyance means, and the inverting conveyance means, and executes a first step of conveying the medium delivered to the media conveyance path in a first direction, and printing on a first side of the medium by a printhead, a second step of conveying the printed medium in a second direction in the reverse of the first direction from the media conveyance path to the inverting conveyance path, and a third step of conveying the medium through the inverting conveyance path and feeding the medium in the first direction from the inverting conveyance path to the media conveyance path after inverting the front and back, and conveys the medium in the second direction in the second step at a higher conveyance speed than the conveyance speed when conveying the medium in the first direction in the first step.

After printing on the first side of the medium, this aspect of the invention changes the conveyance direction to the opposite direction (second direction) as when printing, conveys the medium faster than when printing, and inverts the front and back of the medium. This shortens the time required to complete the media inversion operation compared with slowing the conveyance speed of the medium during inversion, or imposing a waiting period for the ink to dry. In addition, when the trailing end of the medium is no longer between the conveyance roller pair when printing ends, the trailing end of the medium can be returned to between the conveyance roller pair while there is still little change in the condition of the medium, and can improve the success rate of the operation nipping the trailing end of the medium with the conveyance roller pair. The chance of a paper jam occurring is therefore low. In tests of conveyance control in an inkjet printer, the inventors confirmed there is little ink bleeding in the medium after printing, and little transfer of ink to the conveyance roller pair. Loss of print quality and the occurrence of paper jams can therefore be suppressed, and throughput can be improved in duplex printing. Paper jams can also be reduced and throughput improved when printing with a printhead other than an inkjet head.

Example 15

In a printer according to another aspect of the invention, the control unit conveys the medium in the first direction through the media conveyance path in the first step by driving a first conveyance motor of the media conveyance means, and conveys the medium through the inverting conveyance path in the third step at a higher speed than the conveyance speed when conveying the medium in the first direction in the first step by driving a second conveyance motor of the inverting conveyance means.

By using a dedicated motor disposed to the inverting unit to convey media through the inverting conveyance path, this configuration enables conveying and inverting the medium at a faster speed than when printing.

Example 16

In a printer according to another aspect of the invention, a media detector is disposed to the media conveyance path on the second direction side of the print position of the printhead; the media conveyance means has a conveyance roller pair disposed between the print position and the detection position of the media detector; and the control unit detects the medium conveyed in the second direction by the media detector in the second step, determining if nipping the medium between a paper feed roller pair was successful based on the output of the media detector, executing a retry operation that conveys the medium in the first direction and then in the second direction when the nipping operation is determined to have failed, and repeating the retry operation until the nipping operation succeeds.

This configuration can prevent media from stopping and jamming in front of the conveyance roller pair because conveyance can be stopped when nipping fails. The medium can also be fed quickly to the inverting conveyance path because the nipping operation can be repeated until the nipping operation succeeds.

Example 17

In a printer according to another aspect of the invention, the control unit pauses the medium for a predetermined wait period before starting conveyance in the second direction after conveying the medium in the first direction in the retry operation.

This configuration can prevent ink bleeding and ink transferring to the conveyance roller pair, and improve the success rate of the retry operation.

Example 18

In a printer according to another aspect of the invention, the control unit conveys the medium in the second direction in the retry operation at a slower speed than the conveyance speed when conveying the medium in the first direction in the first step.

This configuration can prevent ink bleeding and ink transferring to the conveyance roller pair, and improve the success rate of the retry operation.

Example 19

In a printer according to another aspect of the invention, the control unit releases nipping between the paper feed roller pair when conveying the medium in the second direction in the retry operation.

This configuration can improve the success rate of the retry operation by separating one roller from the other roller of the conveyance roller pair.

Example 20

In a printer according to another aspect of the invention, the printhead is an inkjet head that ejects ink to the medium; and the control unit positions the inkjet head and the carriage that carries the inkjet head to a standby position where part of the carriage overlaps part of the medium passing through the media conveyance path and the nozzle face of the inkjet head is retracted from the position overlapping the medium before starting the second step after printing on the first side of the medium.

This configuration can suppress the occurrence of paper jams because deformation of the media by ink can be limited by the carriage. Printing on the second side of the medium can also start from the standby position, and printing on the back side can therefore start quickly.

Example 21

Another aspect of the invention is a printer comprising: a media conveyance path that conveys a sheet medium; a printhead that prints on media conveyed through the media conveyance path; a media delivery path that supplies the medium to the media conveyance path; a loop-shaped inverting conveyance path that inverts the front and back of media fed thereto from the media conveyance path and returns the media to the media conveyance path; a media conveyance means that conveys the medium through the media delivery path, the media conveyance path, and the inverting conveyance path; and a control unit that controls the printhead and the media conveyance means, and executes a first step of conveying the medium fed from a media delivery path to a media conveyance path in a first direction, and printing on a first side of the medium by a printhead, a second step of conveying the printed medium in a second direction in the reverse of the first direction from the media conveyance path to the inverting conveyance path, and a third step of conveying the medium through the inverting conveyance path and feeding the medium in the first direction from the inverting conveyance path to the media conveyance path after inverting the front and back, determines the conveyance position of the trailing end of the medium when printing on the first side of the medium in the first step ends, and controls at least one of printing on the first side of the medium, and conveying the medium after the first side is printed, based on the result of determining the conveyance position.

To change the conveyance direction to the direction opposite the printing direction and feed the medium to the inverting conveyance path after printing on one side of the medium during duplex printing, this configuration first determines the conveyance position of the trailing end of the medium when printing on the one side is completed, that is, the conveyance position of the trailing end of the medium before starting the operation that feeds the medium into the inverting conveyance path. When feeding the medium to the inverting conveyance path in the opposite direction as when printing, optimum conveyance control resulting in the shortest conveyance distance and few problems such as paper jams and failing to feed the medium into the inverting conveyance path differs according to the starting position of the conveyed medium. The conveyance position of the medium when printing ends can be adjusted by means of control when printing as well as by conveyance control after printing. This control method can therefore suppress problems such as paper jams and improve throughput during duplex printing.

Example 22

In a printer according to another aspect of the invention, the media conveyance means includes a conveyance roller pair disposed on the second direction side of the printhead; a junction is disposed to the media conveyance path on the second direction side of the conveyance roller pair between the media delivery path and the inverting conveyance path and media conveyance path; the junction is configured to feed the medium from the media delivery path to the media conveyance path in the first direction, and feed the medium from the media conveyance path to the inverting conveyance path in the second direction; and the control unit determines if the conveyance position of the trailing end of the medium when printing on the first side of the medium in the first step ends is in an un-nipped area between the conveyance roller pair and the printhead, a reversible area between the conveyance roller pair and the junction, or a non-reversible area on the media delivery path side of the junction, and controls at least one of printing on the first side of the medium, and conveying the medium after the first side is printed, based on the result of determining the conveyance position.

This configuration determines whether or not to apply control based on the success of the operation nipping the trailing end of the medium with the conveyance roller pair based on whether or not the trailing end of the medium has separated from between the conveyance roller pair. Whether the medium must be conveyed further in the first direction after printing one side ends also depends on if the trailing end of the medium is on the media delivery path side. This aspect of the invention can therefore suppress an unnecessary drop in throughput, and suppress problems such as paper jams.

Example 23

In a printer according to another aspect of the invention, the control unit also conveys the medium further in the first direction after printing on the first side of the medium ends in the first step, moves the trailing end of the medium into the reversible area, and then starts conveyance in the second direction in the second step, when the conveyance position of the trailing end of the medium when printing on the first side of the medium ends is determined to be in the non-reversible area.

This configuration enables reliably feeding the medium into the inverting conveyance path.

Example 24

In a printer according to another aspect of the invention, a recording means formation area is disposed to the printhead at a position facing the medium through a specific range of the medium conveyance direction. The control unit conveys the medium in the first direction and prints on the medium each time the printhead scans a direction perpendicular to the first direction in the first step; and when the conveyance position of the trailing end of the medium is determined to be in the un-nipped area when printing on the first side of the medium ends, controls the conveyance position of the medium during the last scan by the printhead in the first step, and printing on the first side of the medium, so that the print data printed to a position closest to the trailing end of the first side of the medium is printed using the recording means disposed in the recording means formation area nearest the conveyance roller pair.

This configuration enables minimizing the distance between the trailing end of the medium when printing on the first side ends and the conveyance roller pair. The medium can therefore be conveyed to between the conveyance roller pair while there is little change in the medium, and can improve the success rate of the nipping operation. Throughput can also be improved because the conveyance distance for feeding the medium to the inverting conveyance path is short and the time required for the inversion operation is short.

Example 25

In a printer according to another aspect of the invention, the control unit also executes a fourth step of conveying the medium fed to the media conveyance path in the first direction after inverting the front and back sides in the third step, and printing on the second side of the medium by the printhead, the fourth step conveying the medium in units of the maximum width that can be printed in one pass of the printhead and printing on the second side each time the printhead scans in a direction perpendicular to the first direction.

This configuration enables controlling the conveyance position of the medium when printing on the second side ends after inversion to as far downstream as possible, and enables printing the last pass when the length of un-nipped medium at the trailing end is as short as possible. A drop in print quality due to deformation of the medium can therefore be suppressed. Throughput can also be improved because the medium can be quickly discharged and printing the next medium can start quickly.

Example 26

In a printer according to another aspect of the invention, when the conveyance position of the trailing end of the medium is determined to be in the un-nipped area when printing on the first side of the medium ends, the control unit detects the medium conveyed in the second direction by a media detector disposed on the second direction side of the conveyance roller pair in the second step, determines based on the output from the media detector if a nipping operation that nips the medium between the conveyance roller pair is successful, executes a retry operation that conveys the medium in the first direction and then conveys the medium in the second direction when the nipping operation is determined to have failed, and repeats the retry operation until the nipping operation succeeds.

This configuration can prevent media from jamming in front of the conveyance roller pair, creating a paper jam. The time required to feed the medium into the inverting conveyance path can also be shortened and throughput improved because the retry operation repeats automatically until the nipping operation succeeds.

Effect of the Invention

By back-feeding the medium at high speed after printing, the invention shortens the time required to complete the media inversion operation. In addition, when the trailing end of the medium is no longer between the conveyance roller pair when printing ends, the trailing end of the medium can be returned to between the conveyance roller pair while there is still little change in the condition of the medium, and can improve the success rate of the operation nipping the trailing end of the medium with the conveyance roller pair. Tests have confirmed that when using this conveyance control method in an inkjet printer, there is little ink bleeding in the printed medium and little transfer of ink to the conveyance roller pair.

To change the conveyance direction to the direction opposite the printing direction and feed the medium to the inverting conveyance path after printing on one side of the medium during duplex printing, the invention first determines the conveyance position of the trailing end of the medium when printing on the one side is completed, that is, the conveyance position of the trailing end of the medium before starting the operation that feeds the medium into the inverting conveyance path, and controls conveyance after printing and controls conveyance while printing accordingly. Failure to feed the medium to the inverting conveyance path, failure nipping the trailing end of the medium with the conveyance roller pair, and the conveyance distance becoming unnecessarily long, can therefore be prevented. A drop in print quality and paper jams during duplex printing can therefore be suppressed while improving throughput in duplex printing.

Other objects and attainments together with a fuller understanding of the invention will become apparent and appreciated by referring to the following description and claims taken in conjunction with the accompanying drawings.

BRIEF DESCRIPTION OF THE DRAWINGS

FIG. 4A and FIG. 4B are a vertical section view and a partial section view, respectively, of the printer shown in FIG. 1.

DESCRIPTION OF EMBODIMENTS

A preferred embodiment of a duplex printing capable printer having a inverting conveyance path according to the present invention is described below with reference to the accompanying figures.

General Configuration of a Printer

Figure 1:
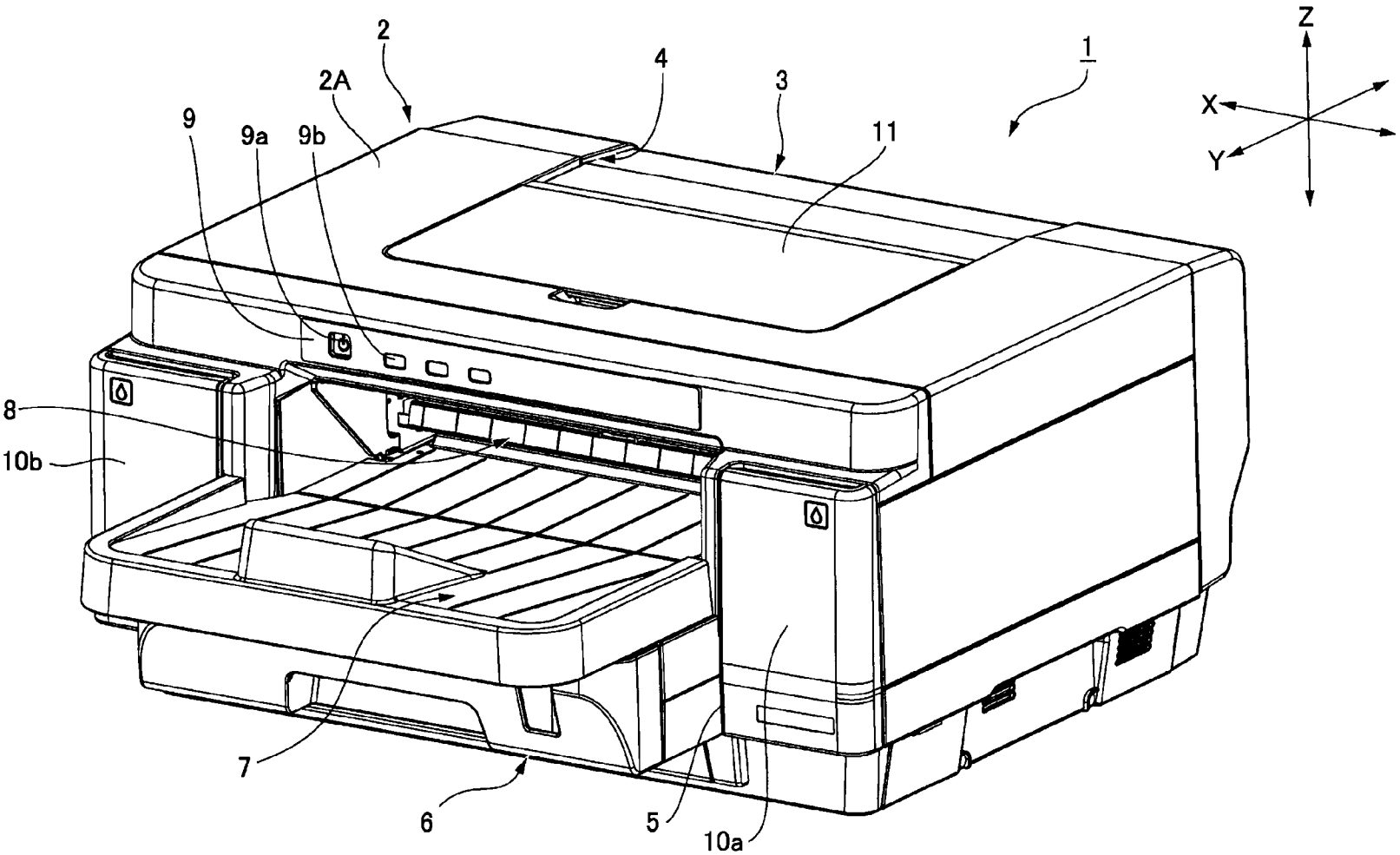
FIG. 1 is an oblique front view of a printer according to the invention.
Figure 2:
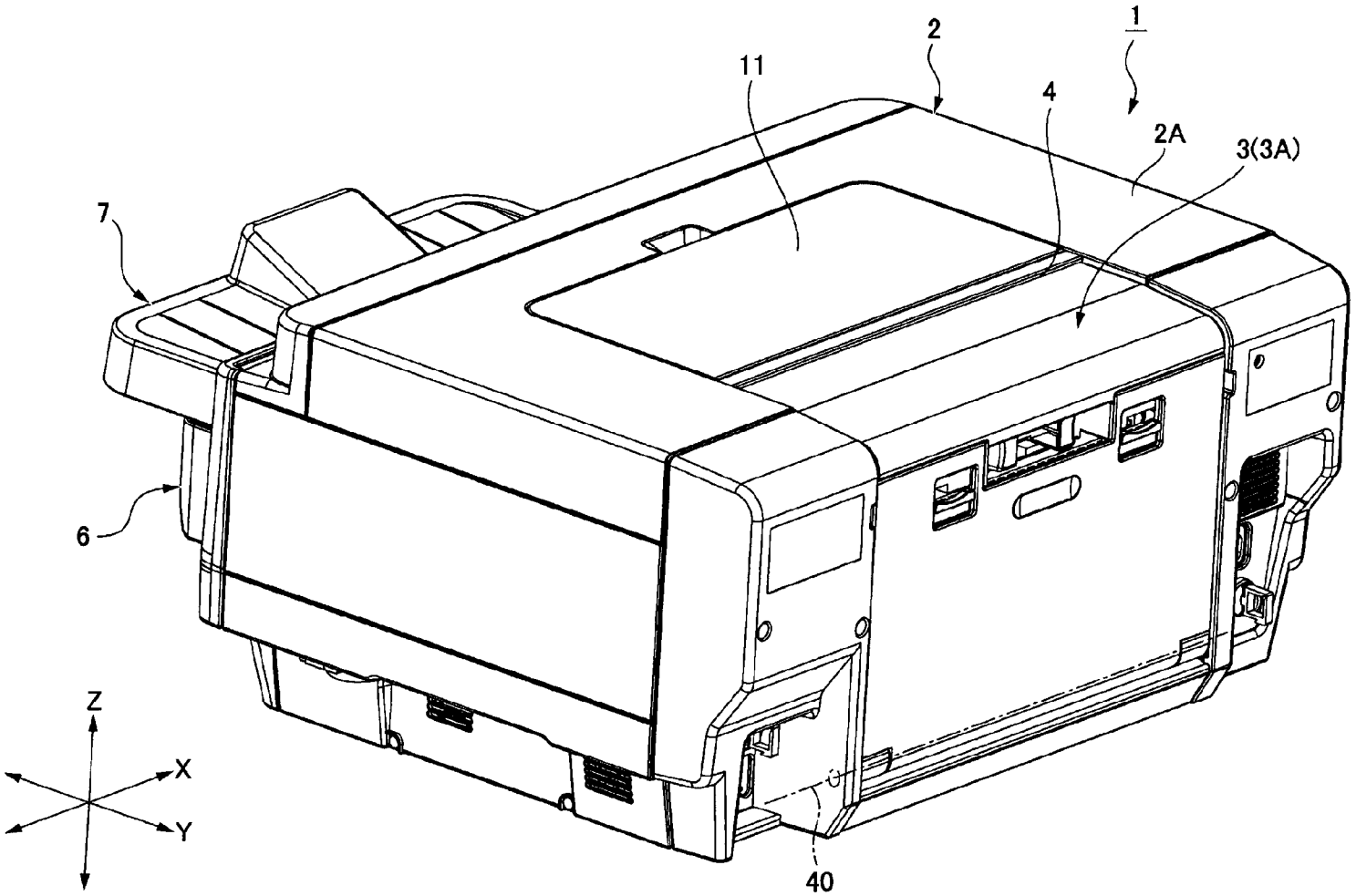
FIG. 2 is an oblique rear view of the printer with the inverting unit closed.
Figure 3:
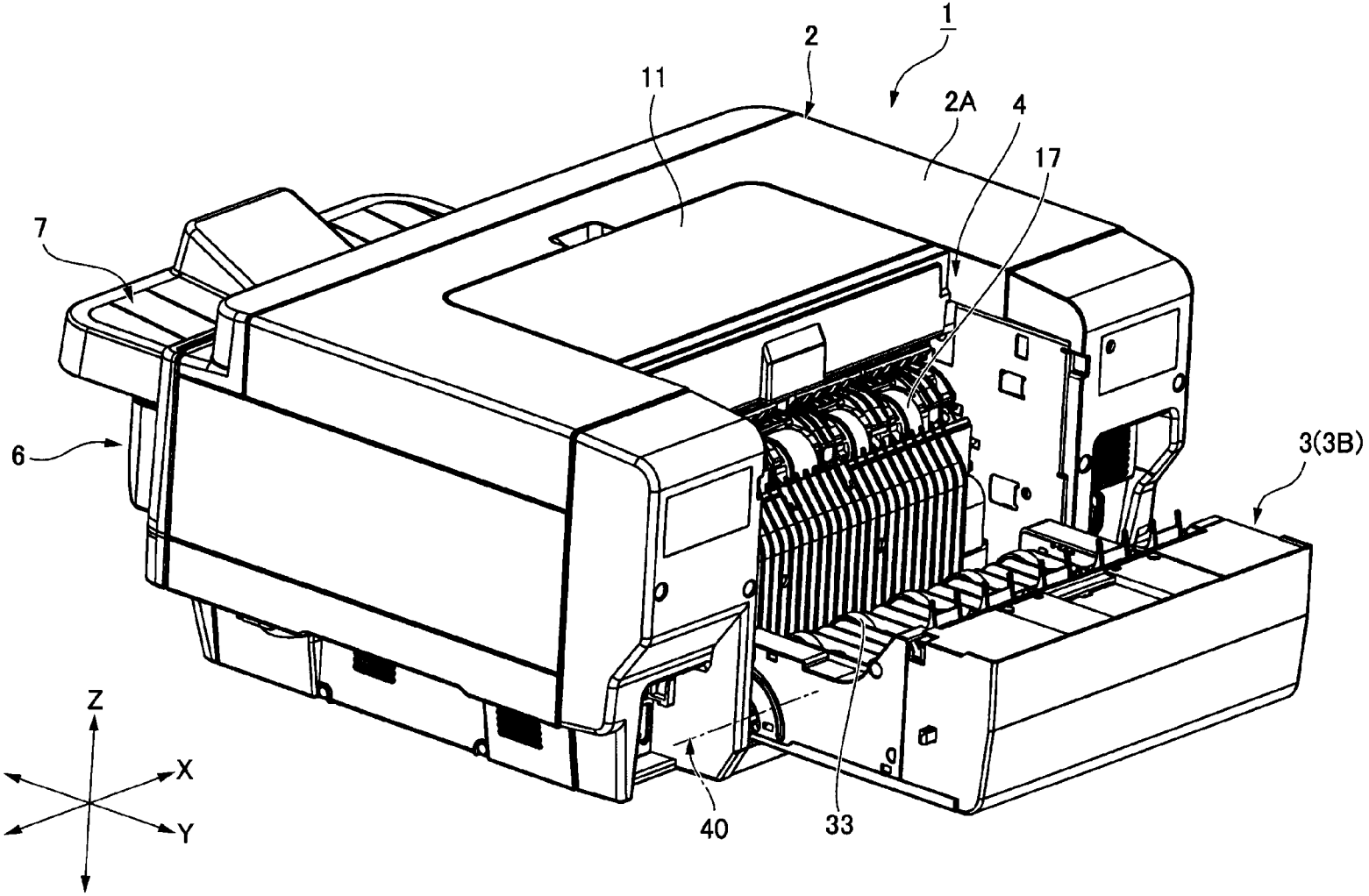
FIG. 3 is an oblique rear view of the printer when the inverting unit is open.

FIG. 1 is an external oblique view from the front of an inkjet printer ("printer" below) according to this embodiment of the invention, and FIG. 2 and FIG. 3 are external oblique views of the printer from the back. FIG. 4A is a vertical section view and FIG. 4B is a partial section view of the internal configuration of the printer.

The general configuration of the printer 1 is described referring primarily to FIG. 1 and FIG. 2. The printer 1 has a printer cabinet 2 and a inverting unit 3. The printer cabinet 2 is a basically rectangular box-like shape that is long on the transverse axis X widthwise to the printer, and has a recess 4 in the middle of the back where the inverting unit 3 is installed. The inverting unit 3 is a unit for inverting the front and back sides of the printing paper P ("paper P" below), which is a form of sheet media, and then returning the inverted paper P into the printer cabinet 2.

As will be understood from FIG. 2 and FIG. 3, the inverting unit 3 can open and close pivoting on a pivot axis 40 located at the bottom on the vertical axis Z of the printer. When in the closed position 3A shown in FIG. 2, the inverting unit 3 is standing upright on the vertical axis Z, and the back cover is positioned substantially flush with the back left and right sides of the printer cabinet 2. In the open position 3B shown in FIG. 3, the inverting unit 3 is dropped to the back on the longitudinal axis Y to a substantially horizontal position. In the open position 3B, part of the inverting conveyance path 14 described below is open as shown in FIG. 3. Paper jams and other problems occurring on these conveyance paths can therefore be easily handled by opening the inverting unit 3.

A paper cassette loading unit 5 is disposed to the front of the printer cabinet 2. The paper cassette loading unit 5 opens to the front on the longitudinal axis Y at a position toward the bottom on the vertical axis Z in the front of the printer cabinet 2. A paper cassette 6 can be loaded from the front into the paper cassette loading unit 5. A paper discharge tray 7 is attached at the top of the paper cassette loading unit 5. The paper discharge tray 7 extends substantially horizontally to the front. A rectangular paper exit 8 extending toward the back of the printer is formed at the top of the paper discharge tray 7.

An operating panel 9 is at the front of the printer above the paper exit 8. The operating panel 9 includes a power switch 9*a* and a plurality of state indicators 9*b*. Rectangular access doors 10*a*, 10*b* are attached to the front of the printer on opposite sides of the paper discharge tray 7 and paper exit 8. When the access doors 10*a*, 10*b* are open, the ink cartridge loading unit (not shown in the figure) opens and the ink cartridges (not shown in the figure) can be replaced.

The top of the printer is flat, and has an access cover 11 attached in the middle for maintenance.

Internal Configuration of the Printer

The internal configuration of the printer 1 is described next with reference to FIGS. 4A and 4B. A paper supply path 12 (media supply path), main conveyance path 13 (media conveyance path), and inverting conveyance path 14 are formed inside the printer 1. The paper supply path 12 and main conveyance path 13 are formed inside the printer cabinet 2, and the inverting conveyance path 14 is formed inside the inverting unit 3.

The paper supply path 12 is a conveyance path that conveys paper P of a specific size stored in a stack in the paper cassette 6 to the main conveyance path 13. The paper supply path 12 extends diagonally up from the back end of the paper cassette loading unit 5 on the longitudinal axis Y, curves toward the front, and connects to the main conveyance path 13. Paper P stored in the paper cassette 6 is fed by a paper feed roller 15 to the paper supply path 12. The supplied paper P is fed one sheet at a time through the nipping part of a conveyance roller 17 and a retard roller 16, and is conveyed through the nipping part of the conveyance roller 17 and a follower roller 18 to the main conveyance path 13. In other words, of the media conveyance means in the printer 1, the media conveyance means that conveys the paper P through the paper supply path 12 includes the paper feed roller 15, retard roller 16, conveyance roller 17, follower roller 18, and a drive source therefor.

The main conveyance path 13 is the conveyance path extending substantially horizontally along the longitudinal axis Y to the paper exit 8. The printhead 22 and related parts are disposed above, and the paper cassette loading unit 5 and paper supply path 12 are disposed below, the main conveyance path 13. Disposed along the main conveyance path 13 from the upstream side in the paper conveyance direction are a paper detection lever 20*a*, a paper feed roller pair 21, a printhead 22, a first discharge roller pair 23, and a second discharge roller pair 24. The printhead 22 is an inkjet head, and a platen 25 is disposed opposite the nozzle face with a specific gap therebetween.

Paper P fed from the paper supply path 12 to the main conveyance path 13 is conveyed by the conveyance roller 17 to the paper feed roller pair 21 while pushing up on the paper detection lever 20*a*. The paper P fed into the paper feed roller pair 21 is conveyed passed the printing position of the printhead 22 by the paper feed roller pair 21 toward the first discharge roller pair 23. The paper P fed to the first discharge roller pair 23 passes the first discharge roller pair 23 and second discharge roller pair 24, and is discharged from the paper exit 8 onto the paper discharge tray 7.

The inverting conveyance path 14 formed inside the inverting unit 3 is located below the main conveyance path 13 on the vertical axis Z, and is a conveyance path that generally forms a loop. The inverting conveyance path 14 includes an upstream path 26 that connects to the upstream end of the main conveyance path 13 and extends substantially horizontally to the back on the longitudinal axis Y, a descending path 27 that curves and extends down in a straight line on the vertical axis Z from the upstream path 26, a bottom path 28 that connects to the descending path 27 and curves to the front on the longitudinal axis Y, and an ascending path 29 that curves and extends upward from the bottom path 28.

The top part of the ascending path 29 curves at an angle to the printer front, and merges with the paper supply path 12 in the middle. More specifically, ascending path 29 and the downstream part of the paper supply path 12 form a common path 30. This common path 30 is a curved path extending along the outside of the conveyance roller 17.

A first conveyance roller 31 and a follower roller 32 are disposed between the upstream path 26 and the descending path 27, and a second conveyance roller 33 and a follower roller 34 are disposed between the bottom path 28 and the ascending path 29. Paper P conveyed from the main conveyance path 13 to the inverting conveyance path 14 is nipped by the first conveyance roller 31 and follower roller 32, then conveyed by the first conveyance roller 31 to the nipping part of the second conveyance roller 33 and follower roller 34, and then conveyed by the second conveyance roller 33 to the nipping part of the conveyance roller 17 and follower roller 18. The paper P is then fed by the conveyance roller 17 to the main conveyance path 13 again.

By passing through the loop of this inverting conveyance path 14, the paper P is reversed front and back and returned to the main conveyance path 13. Printing on both sides of the paper P is therefore enabled by conveying the paper through the inverting conveyance path 14.

A path-changing flapper 36 is disposed at the junction 35 of the upstream end of the main conveyance path 13, the upstream end of the inverting conveyance path 14, and the downstream end of the common path 30. The path-changing flapper 36 can pivot up and down on the vertical axis Z at the back end of the flapper 36 on the longitudinal axis Y. The path-changing flapper 36 is normally held by its own weight with the main part of the flat at the front on the longitudinal axis Y resting on the outside of the conveyance roller 17.

Paper P back-fed from the main conveyance path 13 side in this position is guided by the path-changing flapper 36 to the inverting conveyance path 14 side. The paper P then passes through the inverting conveyance path 14 and returns to the junction 35. The paper P returned to the junction 35 is conveyed to the main conveyance path 13 while pushing the path-changing flapper 36 up. After the paper P passes, the path-changing flapper 36 returns by its own weight to rest on the outside surface of the conveyance roller 17.

The path-changing flapper 36 is also pushed up by the paper P fed from the paper supply path 12 to the main conveyance path 13 when paper P is supplied from the paper cassette 6. After the paper passes, the path-changing flapper 36 returns of its own weight to rest on the outside of the conveyance roller 17. Paper P back-fed from the main conveyance path 13 will therefore not go through the common path 30 into the ascending path 29 or the paper supply path 12. The paper P path can also be changed by a simple configuration without using a separate drive power source or urging member.

Figure 5:
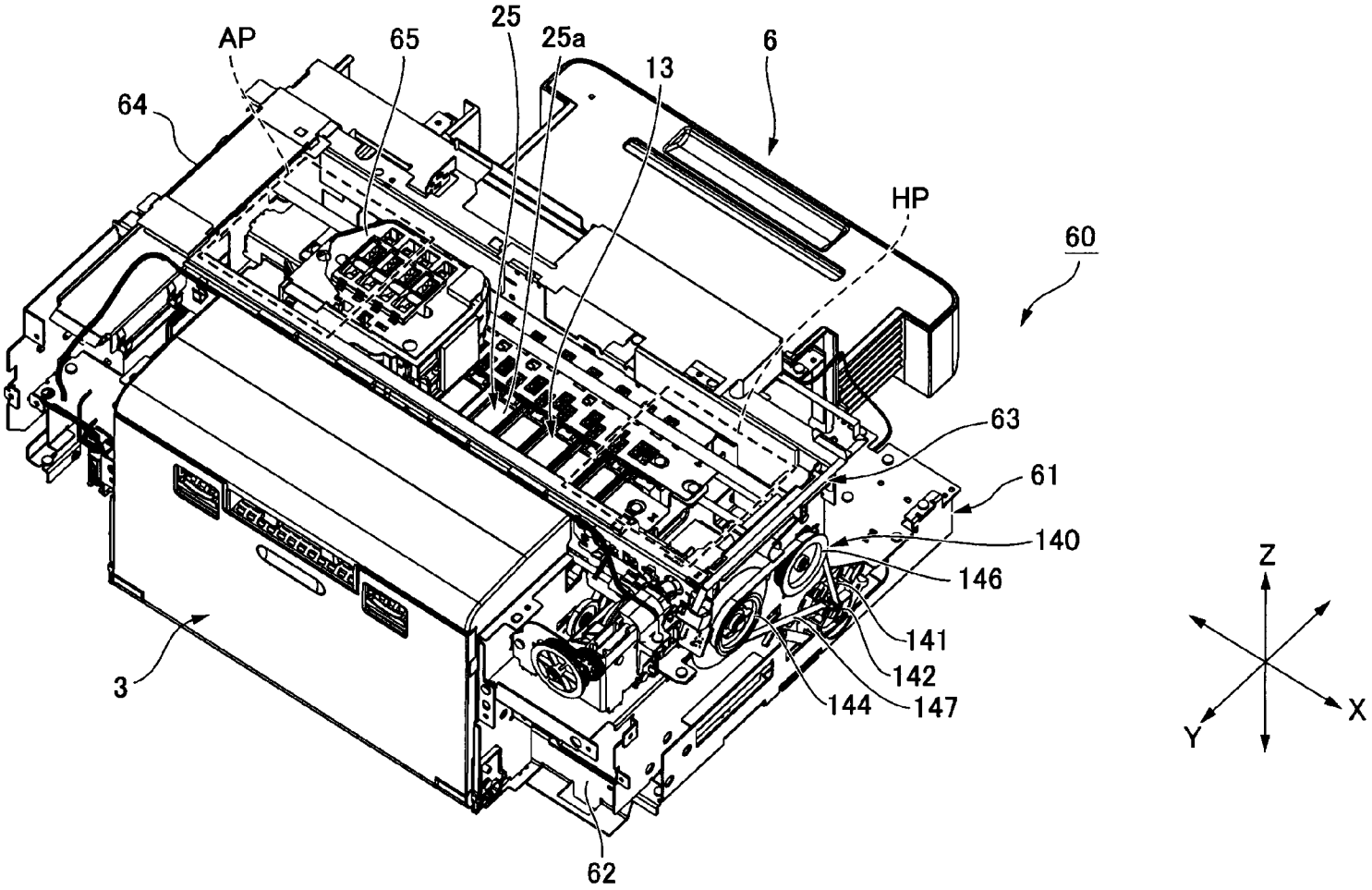
FIG. 5 is an oblique view showing the print mechanism unit and the inverting unit when the main case of the printer is removed.

FIG. 5 is an oblique view of the print mechanism unit and inverting unit 3 with the main case 2A of the printer cabinet 2 removed. The print mechanism unit 60 includes a sheet metal print unit frame 61 to which parts of the print mechanism unit 60 are assembled. The print unit frame 61 includes a base frame 62, and side frames 63, 64 rising perpendicularly from the base frame 62 at positions on opposite sides of the transverse axis X.

Two carriage guide rails span parallel to the transverse axis X between the top parts of the side frames 63, 64 on the vertical axis Z. A carriage 65 is disposed between the carriage guide rails. The carriage 65 is connected to a timing belt extending on the transverse axis X, and when the timing belt is driven by the carriage drive motor, the carriage 65 slides along the carriage guide rails on the transverse axis X.

The printhead 22 (FIG. 4A) is mounted on the carriage 65, and a platen 25 is disposed below the printhead 22. The platen 25 is a multi-part platen having plural platen segments 25*a* side by side on the transverse axis X, which is the direction of printhead 22 travel. The printhead 22 can move by means of the carriage 65 between the home position HP near one side frame 63, and an away position AP near the other side frame 64. In other words, the printhead 22 can travel reciprocally widthwise across the main conveyance path 13 (print medium conveyance path) formed between the side frames 63, 64.

Drive Source of the Conveyance Rollers in the Main Conveyance Path 13 and Inverting Conveyance Path 14

As shown in FIG. 5, a paper feed motor 141, and a power transfer mechanism 140 that transfers rotation of the paper feed motor 141 to the paper feed roller pair 21 and the first discharge roller pair 23, are assembled on the side of the one side frame 63 facing the outside on the transverse axis X. The paper feed roller pair 21 and first discharge roller pair 23 are disposed to the main conveyance path 13 on the upstream and downstream sides of the platen 25, respectively (see FIG. 4A).

The power transfer mechanism 140 includes a pinion 142 attached to the distal end of the shaft of the paper feed motor 141; a transfer gear 144 affixed to an end of the shaft of the drive roller of the paper feed roller pair 21; a transfer gear 146 affixed to an end of the shaft of the drive roller in the first discharge roller pair 23; and a timing belt 147 mounted on the pinion 142, transfer gear 144, and transfer gear 146.

Rotation of the paper feed motor 141 is transferred from the pinion 142 through the timing belt 147 to the transfer gears 144, 146, and to the drive roller of the paper feed roller pair 21 and the drive roller of the first discharge roller pair 23. The paper feed roller pair 21 and first discharge roller pair 23 rotate synchronously at the same speed in the same direction, and convey the paper P through the main conveyance path 13. Of the media conveyance means of the printer 1, the media conveyance means that conveys paper P through the main conveyance path 13 includes the paper feed roller pair 21, first discharge roller pair 23, second discharge roller pair 24, paper feed motor 141, and power transfer mechanism 140.

Figure 6:
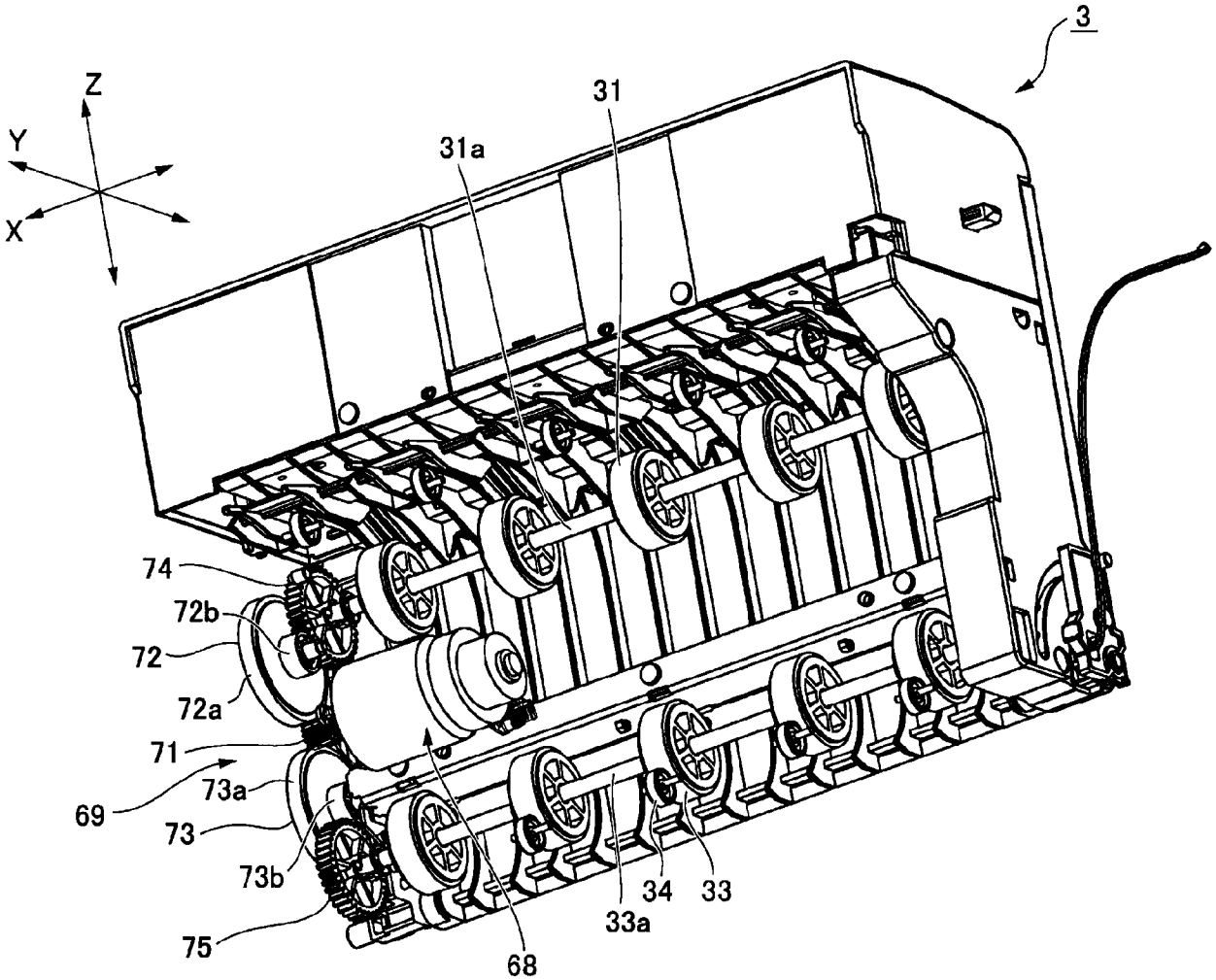
FIG. 6 is an oblique view of the inverting unit with the bottom part of the unit case removed.

FIG. 6 is an oblique view showing the inverting unit 3 without the bottom part of the unit case. The inverting unit 3 includes a conveyance motor 68 as the drive power source for rotationally driving the first and second conveyance rollers 31, 33; and a power transfer mechanism 69 that transfers rotation of the conveyance motor 68 to the first and second conveyance rollers 31, 33.

The conveyance motor 68 is disposed substantially horizontally on the transverse axis X inside the unit case of the inverting unit 3.

The power transfer mechanism 69 includes a pinion 71 affixed to the end of the motor shaft; top and bottom compound transfer gears 72, 73; and top and bottom transfer gears 74, 75. The pinion 71 meshes with the large gears 72*a*, 73*a* of the top and bottom compound transfer gears 72, 73. The small gears 72*b*, 73*b* of the top and bottom compound transfer gears 72, 73 respectively mesh with the top and bottom transfer gears 74, 75. The top and bottom transfer gears 74, 75 are respectively affixed to the end of the shaft of the first conveyance roller 31, and the end of the shaft of the second conveyance roller 33.

Rotation of the conveyance motor 68 is transferred through the top compound transfer gear 72 and the top transfer gear 74 to the first conveyance roller 31, and through the bottom compound transfer gear 73 and the bottom transfer gear 75 to the second conveyance roller 33. The first and second conveyance rollers 31, 33 turn synchronously at the same speed in the same direction, and convey the paper P through the inverting conveyance path 14. More specifically, of the media conveyance means of the printer 1, the media conveyance means that conveys the paper P through the inverting conveyance path 14 includes the first and second conveyance rollers 31, 33, conveyance motor 68, and power transfer mechanism 69.

Separately to the paper feed motor 141, which is the drive source for driving the conveyance rollers (such as the paper feed roller pair 21) of the main conveyance path 13 of the printer cabinet 2, the inverting unit 3 also includes a conveyance motor 68 that drives the paper feed rollers (first and second conveyance rollers 31, 33) of the inverting conveyance path 14, and a dedicated conveyance motor 68 is thus disposed to the inverting unit 3. Because the paper feed precision of conveyance through the inverting conveyance path 14 may be less precise than the paper feed precision during printing, the dedicated conveyance motor 68 can reverse the media at a higher speed than the paper feed rate when printing. As a result, the time required for the inverting operation can be shortened, and throughput can be improved during duplex printing.

Media Detector

A paper detector 20 (media detector) that detects the end of the paper P is disposed to the main conveyance path 13. The paper detection position A of the paper detector 20 is between the upstream end 13*a* of the main conveyance path 13 (FIG. 4A) and the paper feed roller pair 21. The paper detector 20 includes a paper detection lever 20*a* that protrudes to the paper detection position A; a sensor lever 20*b* disposed above the paper detection lever 20*a* on the vertical axis Z; and a transmissive detector 20*c* that detects the sensor lever 20*b*.

When paper P is fed from the upstream side to the main conveyance path 13, the paper detection lever 20*a* is pushed and tilts to the front on the longitudinal axis Y, that is, to the downstream side, by the leading end of the paper P. As a result, the bottom end of the sensor lever 20*b* is pushed up, the sensor lever 20*b* tilts, and the top end of the sensor lever 20*b* separates from the detection position of the transmissive detector 20*c*. That the paper P passed the paper detection position A is therefore detected.

After the trailing end of the paper P passes the paper detection position A and the paper P is back fed (reversed), the paper detection lever 20*a* is pushed by the trailing end of the paper P and tilts to the upstream side, that is, to the back on the longitudinal axis Y. The top end of the paper detection lever 20*a* functions as a cam, and the bottom end of the sensor lever 20*b* is pushed in the same direction whether the paper detection lever 20*a* tilts forward or reverse. The top end of the sensor lever 20*b* therefore separates from the detection position of the transmissive detector 20*c*, and the paper P passing the paper detection position A can be detected. The paper detector 20 therefore functions as a two-way detector that can detect the paper P passing the paper detection position A in both directions, a first direction FF from the upstream side to the downstream side of the main conveyance path 13, and a second direction BF from the downstream side to the upstream side.

First Embodiment

Paper Conveyance Control During Duplex Printing

Paper conveyance control during duplex printing in the first embodiment of the invention is described below.

Figure 7:
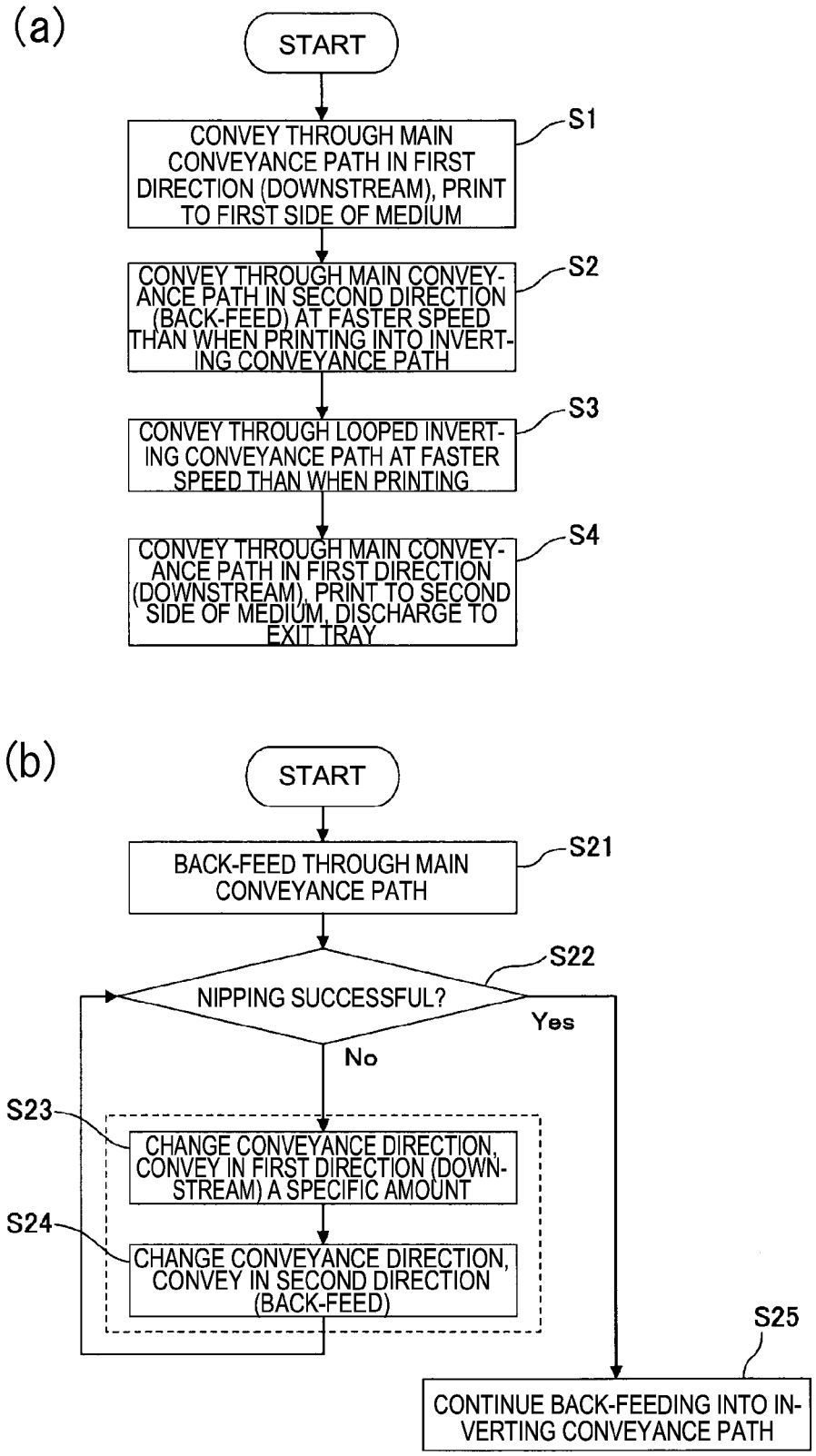
FIGS. 7(*a*) and 7(*b*) are flow charts describing details of media conveyance control during duplex printing, and conveyance control during back-feeding.
Figure 8A:
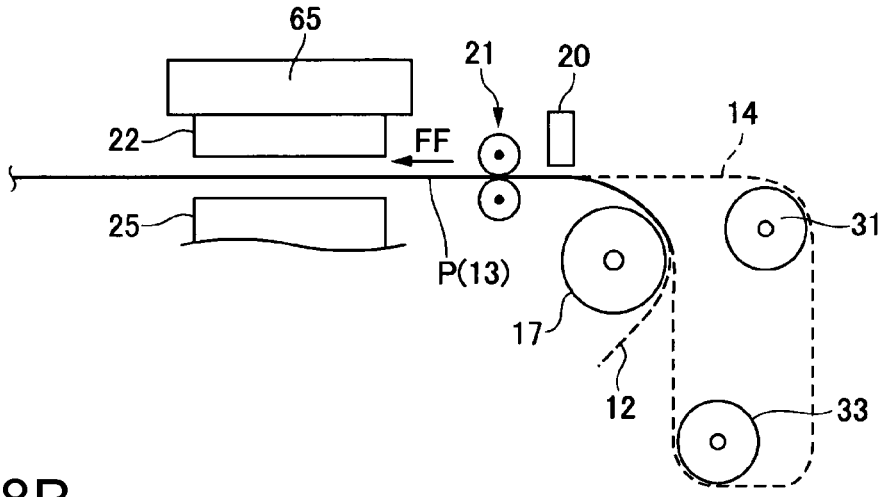
FIGS. 8A-8C schematically describe the position of the paper during conveyance control for duplex printing.
Figure 8B:
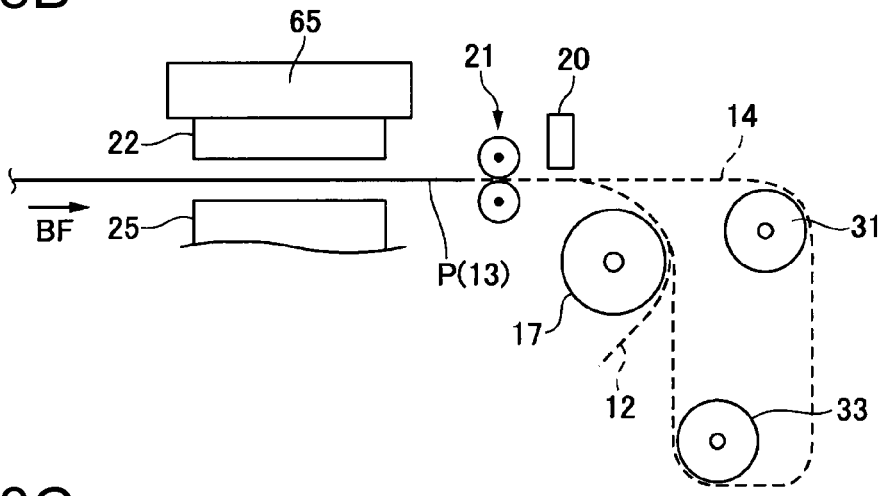
Figure 8C:
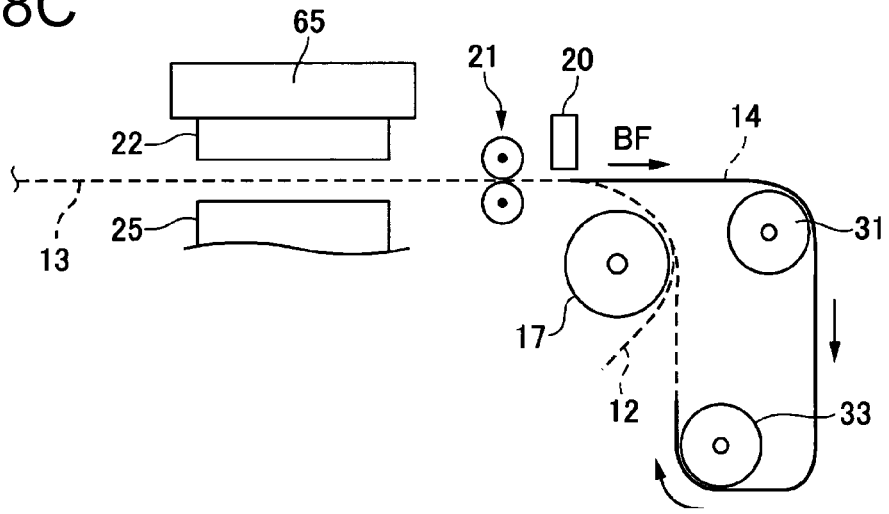

FIG. 7(*a*) is a flow chart of paper conveyance control during duplex printing, and FIG. 7(*b*) is a flow chart of conveyance control when back-feeding the media. FIGS. 8A-8C schematically describe the position of the paper P during conveyance control for duplex printing, FIG. 8A showing the paper P in step S1 in FIG. 7(*a*), FIG. 8B showing the paper P in step S2 in FIG. 7(*a*), and FIG. 8C showing the paper P in step S3 in FIG. 7(*a*).

Basic paper conveyance control during duplex printing is described first with reference to FIG. 7(*a*) and FIG. 8A to C. When the print data is print data for duplex printing, the control unit of the printer 1 prints first on the exposed side of the paper P in step S1 (first step). More specifically, in step S1 the paper feed roller 15, retard roller 16, and conveyance roller 17 feed the paper P from the paper supply path 12 through the common path 30 to the main conveyance path 13 (FIG. 8A). The paper feed roller pair 21 is then driven to convey the paper P in the first direction FF through the main conveyance path 13 to the downstream side, and while the print area on the front side of the paper P passes the print position B of the printhead 22, ejects ink from the ink nozzles of the printhead 22 to the paper P while moving the carriage 65 along the carriage guide rails. Synchronized to the ink ejection operation, the media conveyance means (paper feed roller pair 21, first discharge roller pair 23, and second discharge roller pair 24) of the main conveyance path 13 are driven to convey the paper P a specific amount in the first direction FF. The print data is printed in lines of a specific width on each pass of the carriage 65 through the print area.

When printing the first side of the paper P is finished, the control unit of the printer 1 back-feeds the paper P through the main conveyance path 13 to the inverting conveyance path 14 in step S2 (second step) (FIG. 8B). More specifically, the drive direction of the paper feed roller pair 21 and other parts in step S2 is changed from the first direction FF to the second direction BF, and the paper P is fed back to the upstream side. At the upstream end 13*a* of the main conveyance path 13 (FIG. 4B), the paper P is guided by the path-changing flapper 36 to the inverting conveyance path 14 side, and is fed into the upstream path 26 of the inverting conveyance path 14. The control unit of the printer 1 controls the media conveyance means of the main conveyance path 13 so that the conveyance speed F2 when conveying the paper P in the second direction BF in step S2 is faster than the conveyance speed F1 when conveying the paper P in the first direction FF in step S1.

Next, the control unit of the printer 1 drives the first and second conveyance rollers 31, 33 in step S3 to convey the paper P through the loop-shaped inverting conveyance path 14 (FIG. 8C). More specifically, the control unit controls the inverting conveyance means to convey the paper P through the upstream path 26 in the second direction BF, and sequentially convey the paper P through the descending path 27, bottom path 28, and ascending path 29. The paper P is fed from the ascending path 29 to the common path 30, is guided by the path-changing flapper 36 to the main conveyance path 13, and is fed into the main conveyance path 13. By passing through the inverting conveyance path 14, the paper P is reversed front and back and returned to the common path 30, and is conveyed from the common path 30 in the first direction FF to the main conveyance path 13. As in step S2, the paper P is conveyed through the inverting conveyance path 14 in step S3 at a faster speed than the conveyance speed F1 when conveying the paper P in the first direction FF in step S1.

The control unit of the printer 1 then conveys the reversed paper P through the main conveyance path 13 in the first direction FF in step S4. When the print area on the back side of the paper P passes the print position B of the printhead 22, ink is ejected from the ink nozzles of the printhead 22 to the paper P while the carriage 65 scans across the carriage guide rails as in step S1. The paper feed roller pair 21, for example, is also driven synchronized to the ink ejection operation to convey the paper P in increments of a specific amount in the first direction FF. As in step S1, the paper P is conveyed at the same conveyance speed F1 as when printing on the first side of the medium. When printing is completed, the paper P is then discharged from the paper exit 8 to the paper discharge tray 7 through the first discharge roller pair 23 and second discharge roller pair 24.

Retry Operation

Details of back-feed control of the paper P are described next with reference to FIG. 7(*b*). When the paper P is printed nearly to the trailing end in step S1, the trailing end of the paper P is conveyed downstream from the paper feed roller pair 21, and the trailing end of the paper P is released from between the paper feed roller pair 21. In this event, an operation that nips the trailing end of the paper P to be back-fed between the paper feed roller pair 21 is executed in step S2. If back-feeding the paper P continues when this nipping operation fails, a paper jam will occur.

The control unit of the printer 1 therefore calculates the conveyance distance of the paper P and the current conveyance position of the paper P based on the drive amount of the conveyance mechanism, and controls conveying the paper P based on the calculated conveyance position. During duplex printing, whether or not the trailing end of the paper P will be released from between the paper feed roller pair 21 when printing the front side of the paper P ends is also calculated based on the print data. If it is determined that the trailing end of the paper P will be separated from the paper feed roller pair 21 when printing ends, control is applied as shown in FIG. 7 (*b*) to avoid a paper jam due to the nipping operation failing in step S2.

As described above, a paper detector 20 is disposed to the main conveyance path 13 on the upstream side (the second direction BF side) of the paper feed roller pair 21. In step S21, the control unit of the printer 1 back feeds the paper P and conveys the paper P in the second direction BF. The paper detector 20 detects the paper P conveyed in the second direction BF, and in step S22, the control unit of the printer 1 determines based on the output from the paper detector 20 if the nipping operation was successful. More specifically, if the paper detector 20 does not detect passage of the paper P even though the paper P has been back fed the distance required for the trailing end of the paper P to reach the paper detection position A of the paper detector 20, the control unit of the printer 1 determines the nipping operation failed (step S22 returns NO). However, if the paper P has been back fed the distance required for the trailing end of the paper P to reach the paper detection position A of the paper detector 20, and the paper detector 20 detects the paper P, the control unit of the printer 1 determines the nipping operation succeeded (step S22 returns YES).

If the nipping operation is determined to have failed, the control unit of the printer 1 executes the retry operation of steps S23 and S24. First, in step S23, the control unit changes the conveyance direction of the paper P to the first direction FF, and conveys the paper P a specific amount in the first direction FF. The conveyance speed in the first direction FF at this time is the same as the conveyance speed when printing in step S1. Next, in step S24, the conveyance direction of the paper P changes again to the second direction BF, and the paper P is back fed. Control then returns to step S22, the success of the nipping operation is again determined, and steps S22 to S24 repeat until the nipping operation is determined successful. If the nipping operation is determined successful in step S22, control goes to step S25, and back-feeding the paper P continues until the paper P is fed into the inverting conveyance path 14. As described above, the paper P is conveyed at a higher conveyance speed in step S25 than the conveyance speed in the first direction FF.

Conveyance in the second direction BF in step S24 in this retry operation is preferably at a slower speed than conveyance in the first direction FF. By feeding the paper P at low speed between the paper feed roller pair 21 when the nipping operation fails, the success rate of the nipping operation improves and the chance of the nipping operation failing again can be reduced. Await period could also be imposed instead of using a slower conveyance speed in step S24 in order to improve the success rate of the nipping operation. In other words, after first conveying the paper P in the first direction FF a specific distance in step S23, conveyance could be paused for the preset wait period before starting conveyance in the second direction BF. Alternatively, the paper P could be conveyed in the second direction BF in the retry operation after first releasing the pressure between the drive roller and pressure roller in the paper feed roller pair 21 and forming a gap in the paper feed roller pair.

By thus performing a retry operation in step S2, conveyance can be paused when the nipping operation fails, and paper jams caused by the paper P jamming in front of the paper feed roller pair 21 can be prevented. In addition, because the retry operation can repeat until the nipping operation succeeds, paper can be fed quickly to the inverting conveyance path 14. Yet further, because a wait period is set and low speed conveyance occurs only during the retry operation, the drop in throughput is reduced, and throughput can be improved by increasing the success rate of the retry operation.

The number of times the retry operation repeats is not limited in this embodiment, and the retry operation repeats until the nipping operation succeeds. Alternatively, a maximum number of times the retry operation executes could be set (such as five times), and the paper P conveyance operation could be stopped and an error returned if nipping fails even though the retry operation has executed the maximum number of times.

Figure 9:
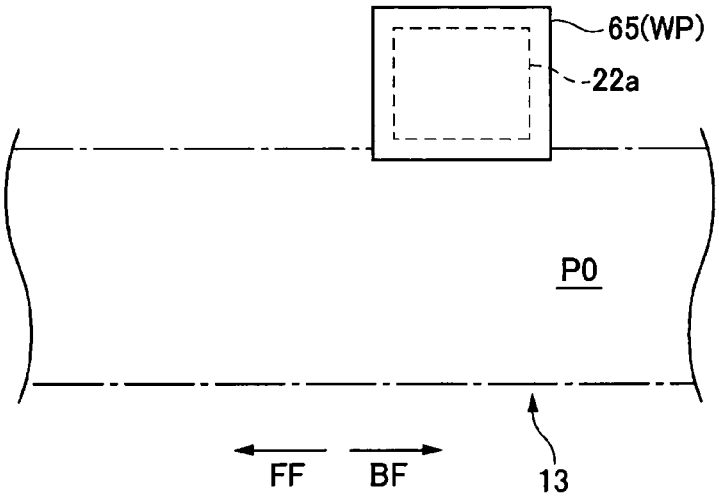
FIG. 9 describes the standby positions of the printhead and carriage during back-feed.

Standby Position of the Printhead 22 and Carriage 65 During the Back-Feed Operation FIG. 9 describes the standby positions of the printhead 22 and the carriage 65 during back-feeding.

Before starting the back-feed operation of step S2 when printing on the first side of the paper P ends in step S1, the control unit of the printer 1 positions the carriage 65 carrying the printhead 22 to a standby position WP for preventing paper jams, and then starts conveying the paper P in the second direction BF. As shown in FIG. 9, this standby position WP is set so that the edge of the carriage 65 overlaps the passing part P0 of the paper P, and the nozzle face 22*a* of the printhead 22 does not overlap the passing part P0, that is, so that the nozzle face 22*a* is retracted to outside the width of the passing part P0. By back-feeding the paper P after thus positioning the printhead 22 and carriage 65, the carriage 65 can limit deformation of the paper P and avoid soiling the paper P by contact with the nozzle face 22*a*. Paper jams can therefore be suppressed while maintaining print quality. Furthermore, because printing on the back side of the paper P starts from the standby position WP, printing on the back side can start quickly.

Printing on the Front Side of the Paper P

Figure 10A:
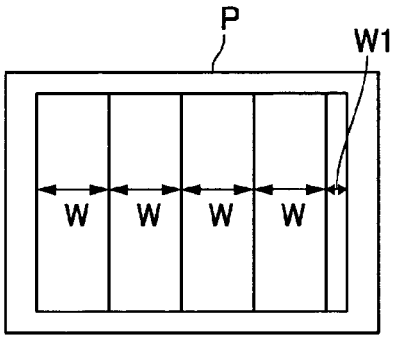
FIGS. 10A-E illustrate a method of printing on the front side of the paper.
Figure 10C:
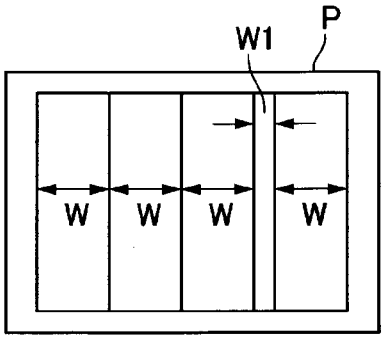
Figure 10B:
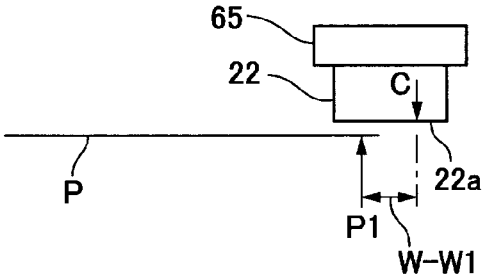
Figure 10D:
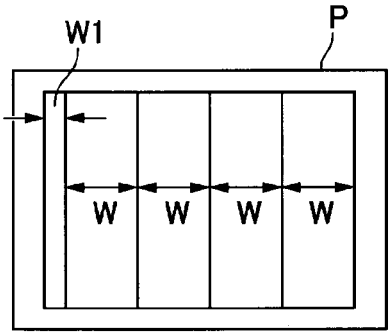
Figure 10E:
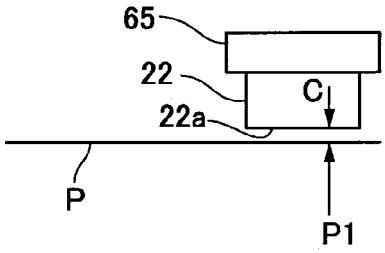

FIGS. 10A-10E illustrate printing on the front side of the paper P, FIGS. 10A AND 10B illustrating printing according to the related art, and FIGS. 10C-10E illustrating printing according to the invention.

As described above, each time the carriage 65 scans the print medium, a band of print data is printed in the print area. This band has a width W corresponding to the length of the nozzle rows formed in the nozzle face of the printhead 22. When the length of the print data is not an integer multiple of this band width W, the printing method of the related art sequentially prints in units of band width W from the leading end of the print area. As a result, the printed width W1 of the last printing pass, that is, the last scan by the carriage 65, is less than the band width W as shown in FIG. 10A. In addition, when the last printing pass is printed, the trailing end P1 of the printed area of the paper P is conveyed to a position distance W-W1 downstream from the position C of the furthest upstream nozzle of the nozzle face 22*a* as shown in FIG. 10B.

When printing to the front side of the paper P in step S1, this embodiment of the invention controls printing so that the position C of the furthest upstream nozzle is at the trailing end P1 of the print area when printing the last printing pass. More specifically, as shown in FIGS. 10C and D, the printed content of each printing pass is controlled so that the printing pass that prints a band narrower than the band width W is a printing pass other than the last pass. This enables matching the position C of the furthest upstream nozzles with the trailing end P1 of the print area as shown in FIG. 10E, and holding the conveyance position of the paper P when the inverting operation starts a distance W-W1 upstream from the conveyance position of the related art shown in FIG. 10B. The conveyance distance required to invert the front and back of the paper P can therefore be shortened compared with the related art, and throughput can be improved by the amount the conveyance distance is shortened.

As described above, after printing to one side of the paper P in this embodiment, the conveyance direction changes to the opposite direction (second direction BF) as the conveyance direction (first direction FF) when printing, and the paper P is conveyed faster than when printing to reverse the front and back of the paper P. As a result, less time is required to complete the paper P inverting operation than configurations that dry the ink by slowing the conveyance speed of the paper P when back-feeding or imposing a wait period as in the related art.

When the trailing end of the paper is released from between the paper feed roller pair 21 when printing ends, this embodiment of the invention can also set the trailing end of the paper between the paper feed roller pair 21 at a time when there is little deformation in the paper P due to ink. The success rate of the paper feed roller pair 21 nipping the trailing end of the paper can therefore be improved, and the chance of paper jams reduced. Tests of this conveyance control method by the inventors have confirmed that there is little bleeding of ink in the printed paper P or transfer of ink to the paper feed roller pair 21. Throughput during duplex printing can therefore be improved while suppressing loss of print quality and the occurrence of paper jams.

Embodiment 2

Paper Conveyance Control During Duplex Printing

Paper conveyance control during duplex printing in the second embodiment of the invention is described below. Paper conveyance control during duplex printing in this second embodiment controls conveyance of paper by recognizing the position of the trailing end of the conveyed paper P.

As shown in FIG. 7(*a*) and FIGS. 8A to C, when the print data is print data for duplex printing, the control unit of the printer 1 prints first on the exposed side of the paper P in step S1 (first step). More specifically, in step S1 the paper feed roller 15, retard roller 16, and conveyance roller 17 feed the paper P from the paper supply path 12 through the common path 30 to the main conveyance path 13 (FIG. 8 A). The paper feed roller pair 21 is then driven to convey the paper P in the first direction FF through the main conveyance path 13 to the downstream side, and while the print area on the front side of the paper P passes the print position B of the printhead 22, ejects ink from the ink nozzles of the printhead 22 to the paper P while moving the carriage 65 along the carriage guide rails in the direction perpendicular to the first and second directions FF, Bf. Synchronized to the ink ejection operation, the media conveyance means (paper feed roller pair 21, first discharge roller pair 23, and second discharge roller pair 24) of the main conveyance path 13 are driven to convey the paper P a specific amount in the first direction FF. The print data is printed in lines of a specific width on each pass of the carriage 65 through the print area.

The nozzle face 22*a* (FIG. 10B) is disposed to the printhead 22 at a position facing the paper P. The nozzle row formation area (recording means formation area) of the nozzle face 22*a* covers a specific range in the paper P conveyance direction, and a row of ink nozzles (recording means) is formed in this area. Each time the carriage 65 makes one pass, the print data is printed to the print area in units of band width W (FIGS. 10A-10E) appropriate to the size of the nozzle rows formed in the nozzle face 22*a* of the printhead 22. As described below, the width that the carriage 65 prints in one pass (one printing pass) may be narrower than the band width W, and can be desirably adjusted.

When printing the first side of the paper P is finished, the control unit of the printer 1 back-feeds the paper P through the main conveyance path 13 to the inverting conveyance path 14 in step S2 (second step) (FIG. 8B). More specifically, the drive direction of the paper feed roller pair 21 and other parts in step S2 is changed from the first direction FF to the second direction BF, and the paper P is fed back to the upstream side. At the upstream end 13*a* of the main conveyance path 13, the paper P is guided by the path-changing flapper 36 to the inverting conveyance path 14 side, and is fed into the upstream path 26 of the inverting conveyance path 14. The control unit of the printer 1 controls the media conveyance means so that the conveyance speed F2 when conveying the paper P in the second direction BF in step S2 is faster than the conveyance speed F1 when conveying the paper P in the first direction FF in step S1. Thus, in the event that the conveyance speed F1 when back-feeding is faster than the conveyance speed F1 when printing, it has been confirmed that there is virtually no ink bleeding in the printed paper P nor transfer of ink to the paper feed roller pair 21, and print quality can be maintained. Note that conveyance speed F2 may be the same as conveyance speed F1.

Next, the control unit of the printer 1 drives the first and second conveyance rollers 31, 33 in step S3 to convey the paper P through the loop-shaped inverting conveyance path 14 (FIG. 8C). More specifically, the control unit controls the inverting conveyance means to convey the paper P through the upstream path 26 in the second direction BF, and sequentially convey the paper P through the descending path 27, bottom path 28, and ascending path 29. The paper P is fed from the ascending path 29 to the common path 30, is guided by the path-changing flapper 36 to the main conveyance path 13, and is fed into the main conveyance path 13. By passing through the inverting conveyance path 14, the paper P is reversed front and back and returned to the common path 30, and is conveyed from the common path 30 in the first direction FF to the main conveyance path 13. As in step S2, the paper P is conveyed through the inverting conveyance path 14 in step S3 at the same speed or at a faster speed than the conveyance speed F1 when conveying the paper P in the first direction FF in step S1.

The control unit of the printer 1 then conveys the reversed paper P through the main conveyance path 13 in the first direction FF in step S4. When the print area on the back side of the paper P passes the print position B of the printhead 22, ink is ejected from the ink nozzles of the printhead 22 to the paper P while the carriage 65 scans across the carriage guide rails as in step S1. The paper feed roller pair 21, for example, is also driven synchronized to the ink ejection operation to convey the paper P in increments of a specific amount in the first direction FF. As in step S1, the paper P is conveyed at the same conveyance speed F1 as when printing on the first side of the medium. When printing is completed, the paper P is then discharged from the paper exit 8 to the paper discharge tray 7 through the first discharge roller pair 23 and second discharge roller pair 24.

Control Based on the Position of the Trailing End of the Paper

Figure 11:
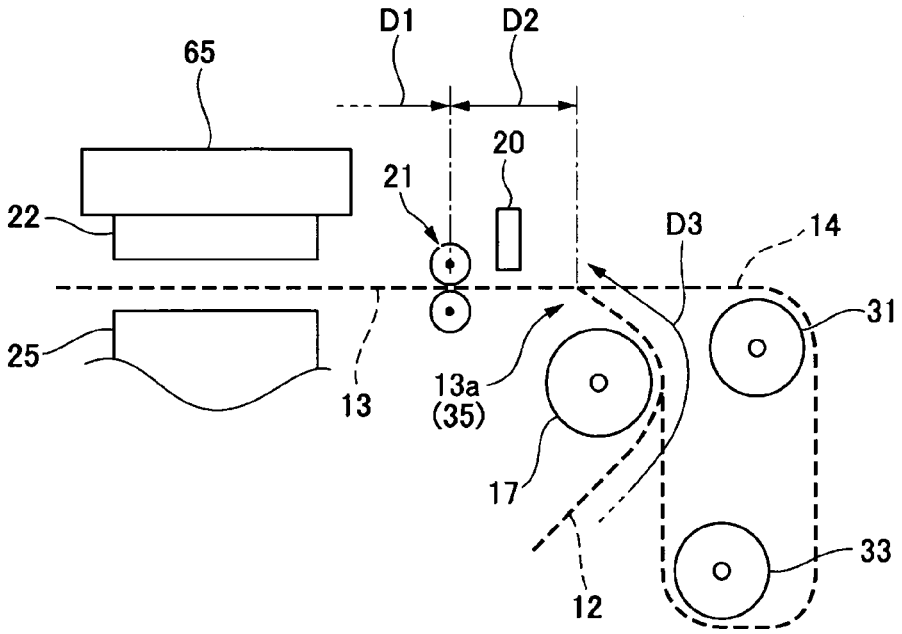
FIG. 11 illustrates the position of the trailing end of the paper when printing on the front side of the paper is completed.

FIG. 11 shows the position of the trailing end of the paper P when printing on the front of the paper P is completed. The control unit of the printer 1 calculates the conveyed position of the paper P by calculating the conveyance distance of the paper P based on the amount the conveyance mechanism is driven, controls printing and conveyance of the paper P based on the calculated conveyance position, and based on the print data pre-calculates the position of the trailing end of the paper P when printing on the first side of the paper P ends during duplex printing. As shown in FIG. 11, when printing the first side of the paper P is completed, the trailing end of the paper P is in one of three areas depending on the content printed on the first side. These areas are (1) an un-nipped area D1 on the downstream side of the paper feed roller pair 21; (2) a reversible area D2 that is upstream from the paper feed roller pair 21 and downstream from the path-changing flapper 36 (junction 35); and (3) a non-reversible area D3 on the paper supply path 12 side of the path-changing flapper 36 (junction 35). The control unit of the printer 1 also pre-calculates which of the areas D1 to D3 shown in FIG. 11 the trailing end of the paper P will be in when printing on the first side of the paper P ends. Based on this decision, the control unit of the printer 1 then controls conveying the paper P (conveyance control after printing the first side) and printing (control when printing on the first side).

(1) Control when the Trailing End Will be in the Un-Nipped Area D1

FIG. 7(*a*), FIG. 9, and FIGS. 10A-E illustrate control when the trailing end of the paper P will be in the un-nipped area D1. As shown in FIG. 7(*a*), if the trailing end of the paper P is conveyed to the downstream side of the paper feed roller pair 21 and stops in the un-nipped area D1 when printing on the first side of the paper P ends in step S1, the trailing end of the paper P will not be between the paper feed roller pair 21. In this event, the trailing end of the paper P back-fed in step S2 is reversed to the paper feed roller pair 21 and nipped therebetween. If this nipping operation fails and back-feeding the paper P continues, the paper P will jam before the paper feed roller pair 21, creating a paper jam. The control unit of the printer 1 therefore applies control to avoid paper jams due to the nipping operation failing and improve throughput as described below.

Retry Control

If the control unit of the printer 1 determines that the trailing end of the paper P will be in the un-nipped area D1 when printing on the first side of the paper P ends, the control unit applies the retry control shown in the flow chart in FIG. 7(*b*) in step S2.

As described above, a paper detector 20 is disposed to the main conveyance path 13 on the upstream side (the second direction BF side) of the paper feed roller pair 21. When retry control is applied, the control unit of the printer 1 back feeds the paper P and conveys the paper P in the second direction BF in step S21. The paper detector 20 detects the paper P conveyed in the second direction BF, and in step S22, the control unit of the printer 1 determines based on the output from the paper detector 20 if the nipping operation was successful. More specifically, if the paper detector 20 does not detect passage of the paper P even though the paper P has been back fed the distance required for the trailing end of the paper P to reach the paper detection position A of the paper detector 20, the control unit of the printer 1 determines the nipping operation failed (step S22 returns NO). However, if the paper P has been back fed the distance required for the trailing end of the paper P to reach the paper detection position A of the paper detector 20, and the paper detector 20 detects the paper P, the control unit of the printer 1 determines the nipping operation succeeded (step S22 returns YES).

If the nipping operation is determined to have failed, the control unit of the printer 1 executes the retry operation of steps S23 and S24. First, in step S23, the control unit changes the conveyance direction of the paper P to the first direction FF, and conveys the paper P a specific amount in the first direction FF. The conveyance speed in the first direction FF at this time is the same as the conveyance speed F1 when printing in step S1. Next, in step S24, the conveyance direction of the paper P changes again to the second direction BF, and the paper P is back fed. Control then returns to step S22, the success of the nipping operation is again determined, and steps S22 to S24 repeat until the nipping operation is determined successful. If the nipping operation is determined successful in step S22, control goes to step S25, and back-feeding the paper P continues until the paper P is fed into the inverting conveyance path 14. As described above, the paper P is conveyed at a higher conveyance speed in step S25 than the conveyance speed F1 in the first direction FF.

Conveyance in the second direction BF in step S24 in this retry operation is preferably at a slower speed than conveyance in the first direction FF. By feeding the paper P at low speed between the paper feed roller pair 21 when the nipping operation fails, the success rate of the nipping operation improves and the chance of the nipping operation failing again can be reduced. Await period could also be imposed instead of using a slower conveyance speed in step S24 in order to improve the success rate of the nipping operation. In other words, after first conveying the paper P in the first direction FF a specific distance in step S23, conveyance could be paused for the preset wait period before starting conveyance in the second direction BF. Alternatively, the paper P could be conveyed in the second direction BF in the retry operation after first releasing the pressure between the drive roller and pressure roller in the paper feed roller pair 21 and forming a gap in the paper feed roller pair.

By thus performing a retry operation in step S2, conveyance can be paused when the nipping operation fails, and paper jams caused by the paper P jamming in front of the paper feed roller pair 21 can be prevented. In addition, because the retry operation can repeat until the nipping operation succeeds, paper can be fed quickly to the inverting conveyance path 14. Yet further, because a wait period is set and low speed conveyance occurs only during the retry operation, the drop in throughput is reduced, and throughput can be improved by increasing the success rate of the retry operation.

The number of times the retry operation repeats is not limited in this embodiment, and the retry operation repeats until the nipping operation succeeds. Alternatively, a maximum number of times the retry operation executes could be set (such as five times), and the paper P conveyance operation could be stopped and an error returned if nipping fails even though the retry operation has executed the maximum number of times.

Standby Position of the Printhead 22 and Carriage 65

The control unit of the printer 1 applies control that uses the carriage 65 to limit deformation of the paper P when the trailing end of the paper P is determined to be in the un-nipped area D1 when printing on the first side of the paper P ends.

More specifically, before starting the back-feed operation of step S2 after printing on the first side of the paper P ends in step S1, the control unit of the printer 1 positions the carriage 65 carrying the printhead 22 to a standby position WP for preventing paper jams, and then starts conveying the paper P in the second direction BF.

As shown in FIG. 9, this standby position WP is set so that the edge of the carriage 65 overlaps the passing part P0 of the paper P, and the nozzle face 22*a* of the printhead 22 does not overlap the passing part P0, that is, so that the nozzle face 22*a* is retracted to outside the width of the passing part P0. By back-feeding the paper P after thus positioning the printhead 22 and carriage 65, the carriage 65 can limit deformation of the paper P and avoid soiling the paper P by contact with the nozzle face 22*a*. Paper jams can therefore be suppressed while maintaining print quality. Furthermore, because printing on the back side of the paper P starts from the standby position WP, printing on the back side can start quickly. Throughput can therefore be improved.

Control when Printing on the First Side and when Printing on the Second Side of the Paper P If the control unit of the printer 1 determines the trailing end of the paper P will be in the un-nipped area D1 when printing on the first side (front) of the paper P ends, the control unit prints on the first side of the paper P in step S1 so that the position of the paper P when starting back-feeding in step S2 is as far upstream as possible. This shortens the conveyance distance until the paper P reaches the inverting conveyance path 14, and can feed the trailing end of the paper between the paper feed roller pair 21 while there is little deformation in the paper P due to ink. When printing on the back (second) side of the paper Pin step S4, the control unit applies control so that the position of the paper P is as far downstream as possible when printing ends. This enables printing when there is little deformation of the paper P, thereby suppressing a drop in print quality, enabling quickly discharging the paper P, and improving throughput.

FIGS. 10A and 10B illustrate printing on the back (second) side of the paper P, and FIGS. 10C to 10E illustrate printing on the front (first) side of the paper P. Printing on the back (second) side of the paper P in step S1 is described first with reference to FIGS. 10A and 10B. As described above, each time the carriage 65 scans the print medium, a band of print data is printed in the print area, and this band has a width W corresponding to the length of the nozzle rows formed in the nozzle face of the printhead 22.

When printing on the back side of the paper P in step S4, the control unit of the printer 1 advances the paper P band width W for each pass of the carriage 65, and sequentially prints the print data in units of band width W from the leading end of the print area. When the length of the print data is not an integer multiple of this band width W, the printed width W1 of the last printing pass, that is, the last scan by the carriage 65, is less than the band width W as shown in FIG. 10A. To print the last pass, the paper P is first conveyed so that the trailing end P1 of the printed area is positioned distance W-W1 downstream from the position C of the furthest upstream nozzle of the nozzle face 22*a* as shown in FIG. 10B, that is, so that the paper P is conveyed as far downstream as possible. As a result, the last pass can be printed to the shortest possible band of paper P released from the paper feed roller pair 21. The last pass can therefore be printed with little change in the paper P due to ink. The conveyance distance required to reverse the front and back of the paper P can therefore be shortened, and the paper P can be quickly discharged and the next print job started. Loss of print quality when printing the back (second) side of the paper P can therefore be suppressed, and throughput can be improved.

Printing on the front of the paper P in step S1 is described next with reference to FIGS. 10C to 10E. When printing to the front side of the paper P in step S1, this embodiment of the invention controls printing so that the position C of the furthest upstream nozzle is at the trailing end P1 of the print area when printing the last printing pass. More specifically, as shown in FIGS. 10C and 10D, the printed content of each printing pass is controlled so that the printing pass that prints a band narrower than the band width W is not the last pass. This enables matching the position C of the furthest upstream nozzles with the trailing end P1 of the print area as shown in FIG. 10E when printing the last pass (the last scan of the printhead 22), and, of the print data to be printed on the front of the paper P, printing the print data (that is, the print data printed at the trailing end P1 of the print area) to be printed closest to the trailing end of the first side with the ink nozzles at the furthest upstream nozzle position C. As a result, the conveyance position of the paper P when the inverting operation starts is a distance W-W1 upstream from the conveyance position shown in FIG. 10B. The conveyance distance until the trailing end of the paper P reaches the paper feed roller pair 21 when back-feeding the paper P in step S2 can therefore be shortened, and the paper P can be nipped with little deformation. Paper jams can therefore be suppressed. Throughput can also be improved because the conveyance distance until the paper P enters the inverting conveyance path 14 is shortened.

A printing pass with a printed width W1 less than the band width W could be printed as the last pass. The last pass can be printed as described in FIG. 10C in this event if the conveyance position of the paper P is adjusted so that the print data printed at the trailing end P1 of the print area is printed by the ink nozzles at the position C of the furthest upstream nozzle.

When printing by ejecting plural different types of ink, the ink nozzles at the furthest upstream position C may be nozzles that cannot print the print data printed at the trailing end P1 of the print area. The conveyance distance for inverting the front and back of the medium can be shortened in this event by printing the trailing end P1 of the print area using the ink nozzles located as far upstream as possible (on the paper feed roller pair 21 side) in the nozzle formation area of the nozzle face 22*a*. More specifically, the paper P is positioned so that the ink nozzles at the furthest upstream side (the paper feed roller pair 21 side) of the ink nozzles that can print the print data to be printed at the trailing end P1 of the print area are opposite the trailing end P1, and the last pass is then printed.

(2) Control when the Trailing End of the Paper is in the Reversible Area D2

When printing on the first side of the paper P is completed in this event, the trailing end of the paper P is nipped by the paper feed roller pair 21 as shown in FIG. 11. If the trailing end of the paper P is downstream from the junction 35 and the paper P is back-fed therefrom in the second direction BF, the trailing end of the paper P is guided by the path-changing flapper 36 to the inverting conveyance path 14. When printing on the first side of the paper P ends in step S1, the control unit of the printer 1 therefore starts back-feeding the media in step S2 from the position at which printing ended. As described above, the conveyance speed during back-feeding is the same as the conveyance speed F1 or greater than the conveyance speed F1 at which the paper P is conveyed in the first direction FF in step S1.

Because there is no chance of the nipping operation failing due to deformation of the trailing end of the paper P where ink was deposited in this case, there is no need to position the carriage 65 in the standby position WP where the edge of the carriage 65 can hold the edge of the paper P down, and the carriage 65 can be completely retracted from above the paper P. However, to shorten the conveyance distance for feeding the paper P to the inverting conveyance path 14 and improve throughput, the first side of the paper P is preferably printed in step S1 by a method whereby printing the last pass is completed with the paper P positioned as far upstream as possible as shown in FIGS. 10C and 10D.

(3) Control when the Trailing End of the Paper is in the Non-Reversible Area D3

Figure 12:
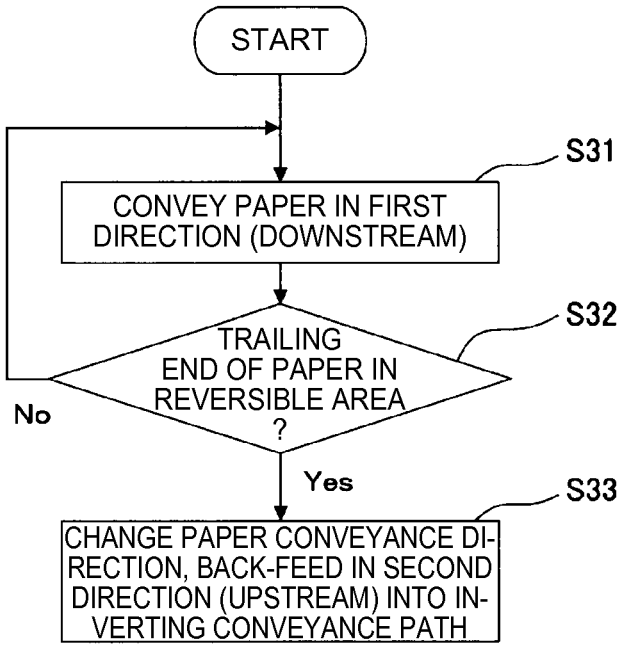
FIG. 12 is a flow chart of controlling feeding paper left in the non-reversible range to the inverting conveyance path.

FIG. 12 is a flow chart of control for feeding paper P in the non-reversible area D3 to the inverting conveyance path 14. As shown in FIG. 11, the non-reversible area D3 is an area on the paper supply path 12 side of the junction 35. When back-feeding starts with the trailing end of the paper P in the non-reversible area D3, the paper P returns to the paper supply path 12 side instead of the inverting conveyance path 14, and the paper P cannot be inverted. In this event, the control unit of the printer 1 feeds the paper P into the inverting conveyance path 14 by the control method shown in the flow chart in FIG. 12.

As shown in FIG. 12, the control unit of the printer 1 monitors output of the transmissive detector 20*c* of the paper detector 20 while conveying the paper P in the first direction FF in step S31. The conveyance speed of the paper P in step S31 is the same as the conveyance speed F1 or greater than the conveyance speed F1 at which the paper P is conveyed in the first direction FF in step S1. Based on the output from the paper detector 20, the control unit of the printer 1 then determines if the trailing end of the paper P moved into the reversible area D2 in step S32. More specifically, if the paper detector 20 detects the trailing end of the paper P, the control unit determines the trailing end of the paper P is in the reversible area D2 (step S32 returns YES). If the paper detector 20 does not detect the trailing end of the paper P (step S32 returns NO), control returns to step S31 and conveyance in the first direction FF continues until the paper detector 20 detects the trailing end of the paper P.

When the paper detector 20 detects the trailing end of the paper P and the trailing end of the paper P is determined to be in the reversible area D2, the control unit of the printer 1 goes to step S33, changes the paper P conveyance direction from the first direction FF to the second direction BF, and then starts back-feeding. In step S33 the paper P is conveyed at conveyance speed F2, which is the same as the conveyance speed F1 or greater than the conveyance speed F1 at which the paper P is conveyed in the first direction FF in step S1. Because the conveyance precision when back-feeding the trailing end of the paper P into the reversible area D2 is lower than the conveyance precision during printing, conveyance at a faster speed than when printing is possible and the drop in throughput can be reduced.

Effect of the Invention

As described above, after printing on one side (front) of the paper P, the invention determines the conveyance position of the trailing end of the paper P based on the print data after printing on the first side ends before changing the conveyance direction from the conveyance direction for printing (first direction FF) to the opposite direction (second direction BF) for feeding the paper Pinto the inverting conveyance path 14. More specifically, the invention determines if the trailing end of the paper P has escaped from between the paper feed roller pair 21, and if it has, determines the trailing end of the paper P to be in the un-nipped area D1. If the trailing end is in the un-nipped area D1, the success of the nipping operation during back-feeding is detected to determine if a retry operation is required. The invention then controls adjusting the conveyance position of the paper P during printing so that the position of the paper P when back-feeding starts is as far upstream as possible so that the trailing end of the paper P where there is little change in the paper P due to the ink can be reliably nipped again by the follower roller 32. Alternatively, the invention controls the carriage 65 to limit deformation of the paper P that has separated from the paper feed roller pair 21. The invention also determines if the trailing end of the paper P is upstream from the junction 35, that is, is in the non-reversible area D3, and if it is in the non-reversible area D3, starts back-feeding after first advancing the paper P in the first direction FF into the reversible area D2.

By thus changing conveyance control after printing or control when printing according to the position of the trailing end of the paper, this embodiment of the invention can reduce the chance of problems such as a drop in print quality or paper jams during duplex printing. The time required for media inversion can also be shortened, and throughput can be improved.

Note that this embodiment of the invention determines if the trailing end of the paper P when printing on the first side of the paper P ends is in one of the areas D1 to D3 shown in FIG. 11, and controls paper P conveyance and printing based on the result of his decision, but a configuration in which only one of paper P conveyance and printing is controlled based on the result of this decision is also conceivable.

Other Embodiments

The foregoing embodiments describe the invention applied to a printer that uses an inkjet head as the printhead, but the invention can obviously also be adapted to printers that print on two sides using a printhead other than an inkjet head. For example, the invention can be applied to a printer that uses a thermal dot impact printhead.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A control method of a printer, comprising:

a first step of conveying a sheet medium delivered to a media conveyance path in a first direction, and printing on a first side of the medium by a printhead;

a second step of conveying the printed medium in a second direction in the reverse of the first direction from the media conveyance path to a loop-shaped inverting conveyance path; and a third step of conveying the medium through the inverting conveyance path and feeding the medium in the first direction from the inverting conveyance path to the media conveyance path after inverting the front and back;

wherein the medium is conveyed in the second direction in the second step at a higher conveyance speed than a conveyance speed when conveying the medium in the first direction in the first step.

2. The control method of a printer described in claim 1, wherein:

the first steps conveys the medium in the first direction through the media conveyance path by driving a first conveyance motor; and the third step conveys the medium through the inverting conveyance path at a higher speed than the conveyance speed when conveying the medium in the first direction in the first step by driving a second conveyance motor different from the first conveyance motor.

3. The control method of a printer described in claim 1, wherein:

the second step includes detecting the medium conveyed in the second direction by a media detector disposed on a second direction side of a print position of the printhead, determining if nipping the medium between a paper feed roller pair disposed between the print position and a detection position of the media detector was successful based on the output of the media detector, executing a retry operation that conveys the medium in the first direction and then in the second direction when the nipping operation is determined to have failed, and repeating the retry operation until the nipping operation succeeds.

4. The control method of a printer described in claim 3, wherein:

the retry operation pauses the medium for a predetermined wait period before starting conveyance in the second direction after conveying the medium in the first direction.

5. The control method of a printer described in claim 3, wherein:

the medium is conveyed in the second direction in the retry operation at a slower speed than the conveyance speed when conveying the medium in the first direction in the first step.

6. The control method of a printer described in claim 3, wherein:

nipping between the paper feed roller pair is released when conveying the medium in the second direction in the retry operation.

7. The control method of a printer described in claim 1, wherein:

the printhead is an inkjet head that ejects ink to the medium;

the control method further comprising a step of positioning the inkjet head and the carriage that carries the inkjet head to a standby position where part of the carriage overlaps part of the medium passing through the media conveyance path and the nozzle face of the inkjet head is retracted from the position overlapping the medium before starting the second step after printing on the first side of the medium.

8. A control method of a printer, comprising:

a first step of conveying a sheet medium fed from a media delivery path to a media conveyance path in a first direction, and printing on a first side of the medium by a printhead;

a second step of conveying the printed medium in a second direction in the reverse of the first direction from the media conveyance path to a loop-shaped inverting conveyance path; and a third step of conveying the medium through the inverting conveyance path and feeding the medium in the first direction from the inverting conveyance path to the media conveyance path after inverting the front and back;

wherein a conveyance roller pair that conveys the medium to the second direction side of the printhead is disposed to the media conveyance path, and a junction is disposed on the second direction side of the conveyance roller pair between the media delivery path and the inverting conveyance path and media conveyance path;

the junction is configured to feed the medium from the media delivery path to the media conveyance path in the first direction, and feed the medium from the media conveyance path to the inverting conveyance path in the second direction; and the control method includes determining if the conveyance position of the trailing end of the medium when printing on the first side of the medium in the first step ends is in an un-nipped area between the conveyance roller pair and the printhead, a reversible area between the conveyance roller pair and the junction, or a non-reversible area on the media delivery path side of the junction; and at least one of controlling printing on the first side of the medium, and controlling conveyance of the medium after the first side is printed, is based on the result of determining the conveyance position.

9. The control method of a printer described in claim further comprising:

conveying the medium further in the first direction after printing on the first side of the medium ends in the first step, moving the trailing end of the medium into the reversible area, and then starting conveyance in the second direction in the second step, when the conveyance position of the trailing end of the medium when printing on the first side of the medium ends is determined to be in the non-reversible area.

10. The control method of a printer described in claim 8, wherein:

a recording means formation area is disposed to the printhead at a position facing the medium through a specific range of the medium conveyance direction;

the first step conveys the medium in the first direction and prints on the medium each time the printhead scans a direction perpendicular to the first direction; and when the conveyance position of the trailing end of the medium is determined to be in the un-nipped area when printing on the first side of the medium ends, the conveyance position of the medium during the last scan by the printhead in the first step, and printing on the first side of the medium, are controlled so that the print data printed to a position closest to the trailing end of the first side of the medium is printed using the recording means disposed in the recording means formation area near the conveyance roller pair.

11. The control method of a printer described in claim 10, further comprising:

a fourth step of conveying the medium fed to the media conveyance path in the first direction after inverting the front and back sides in the third step, and printing on the second side of the medium by the printhead, the fourth step conveying the medium in units of the maximum width that can be printed in one pass of the printhead and printing on the second side each time the printhead scans in a direction perpendicular to the first direction.

12. The control method of a printer described in claim 8, wherein:

when the conveyance position of the trailing end of the medium is determined to be in the un-nipped area when printing on the first side of the medium ends, the second step includes detecting the medium conveyed in the second direction by a media detector disposed on a second direction side of the conveyance roller pair, determining based on the output from the media detector if a nipping operation that nips the medium between the conveyance roller pair is successful, executing a retry operation that conveys the medium in the first direction and then conveys the medium in the second direction when the nipping operation is determined to have failed, and repeating the retry operation until the nipping operation succeeds.

13. A printer comprising:

a media conveyance path that conveys a sheet medium;

a printhead that prints on media conveyed through the media conveyance path;

a loop-shaped inverting conveyance path that inverts the front and back of media fed thereto from the media conveyance path and returns the media to the media conveyance path;

a media conveyance means that conveys the medium through the media conveyance path;

an inverting conveyance means that conveys the medium through the inverting conveyance path; and a control unit that controls the printhead, the media conveyance means, and the inverting conveyance means, and executes a first step of conveying the medium delivered to the media conveyance path in a first direction, and printing on a first side of the medium by a printhead, a second step of conveying the printed medium in a second direction in the reverse of the first direction from the media conveyance path to the inverting conveyance path, and a third step of conveying the medium through the inverting conveyance path and feeding the medium in the first direction from the inverting conveyance path to the media conveyance path after inverting the front and back, and conveys the medium in the second direction in the second step at a higher conveyance speed than a conveyance speed when conveying the medium in the first direction in the first step.

14. The printer described in claim 13, wherein:

the control unit conveys the medium in the first direction through the media conveyance path in the first step by driving a first conveyance motor of the media conveyance means, and conveys the medium through the inverting conveyance path in the third step at a higher speed than the conveyance speed when conveying the medium in the first direction in the first step by driving a second conveyance motor of the inverting conveyance means.

15. The printer described in claim 13, wherein:

a media detector is disposed to the media conveyance path on a second direction side of a print position of the printhead;

the media conveyance means has a conveyance roller pair disposed between the print position and a detection position of the media detector; and the control unit detects the medium conveyed in the second direction by the media detector in the second step, determining if nipping the medium between a paper feed roller pair was successful based on the output of the media detector, executing a retry operation that conveys the medium in the first direction and then in the second direction when the nipping operation is determined to have failed, and repeating the retry operation until the nipping operation succeeds.

16. The printer described in claim 13, wherein:

the printhead is an inkjet head that ejects ink to the medium; and the control unit positions the inkjet head and the carriage that carries the inkjet head to a standby position where part of the carriage overlaps part of the medium passing through the media conveyance path and the nozzle face of the inkjet head is retracted from the position overlapping the medium before starting the second step after printing on the first side of the medium.

17. A printer comprising:

a media conveyance path that conveys a sheet medium;

a printhead that prints on media conveyed through the media conveyance path;

a media delivery path that supplies the medium to the media conveyance path;

a loop-shaped inverting conveyance path that inverts the front and back of media fed thereto from the media conveyance path and returns the media to the media conveyance path;

a media conveyance means that conveys the medium through the media delivery path, the media conveyance path, and the inverting conveyance path, the media conveyance means including a conveyance roller pair disposed on a second direction side of the printhead;

a junction disposed to the media conveyance path on the second direction side of the conveyance roller pair between the media delivery path and the inverting conveyance path and media conveyance path, the junction being configured to feed the medium from the media delivery path to the media conveyance path in the first direction, and feed the medium from the media conveyance path to the inverting conveyance path in the second direction; and a control unit that controls the printhead and the media conveyance means, and executes a first step of conveying the medium fed from a media delivery path to a media conveyance path in a first direction, and printing on a first side of the medium by a printhead, a second step of conveying the printed medium in a second direction in the reverse of the first direction from the media conveyance path to the inverting conveyance path, and a third step of conveying the medium through the inverting conveyance path and feeding the medium in the first direction from the inverting conveyance path to the media conveyance path after inverting the front and back, determines the conveyance position of the trailing end of the medium when printing on the first side of the medium in the first step ends, and controls at least one of printing on the first side of the medium, and conveying the medium after the first side is printed, based on the result of determining the conveyance position, determines if the conveyance position of the trailing end of the medium when printing on the first side of the medium in the first step ends is in an un-nipped area between the conveyance roller pair and the printhead, a reversible area between the conveyance roller pair and the junction, or a non-reversible area on the media delivery path side of the junction, and controls at least one of printing on the first side of the medium, and conveying the medium after the first side is printed, based on the result of determining the conveyance position.

18. The printer described in claim 17, wherein:

when the conveyance position of the trailing end of the medium is determined to be in the un-nipped area when printing on the first side of the medium ends, the control unit detects the medium conveyed in the second direction by a media detector disposed on the second direction side of the conveyance roller pair in the second step, determines based on the output from the media detector if a nipping operation that nips the medium between the conveyance roller pair is successful, executes a retry operation that conveys the medium in the first direction and then conveys the medium in the second direction when the nipping operation is determined to have failed, and repeats the retry operation until the nipping operation succeeds.

* * * * *